US009322398B2

(12) United States Patent
Yi et al.

(10) Patent No.: US 9,322,398 B2
(45) Date of Patent: Apr. 26, 2016

(54) CONCRETE PUMPING STRUCTURE AND CONTROL METHOD THEREOF

(75) Inventors: Xiaogang Yi, Changsha (CN); Xionghui Miao, Changsha (CN); Shijian Liu, Changsha (CN)

(73) Assignees: Hunan Sany Intelligent Control Equipment Co., Ltd., Changsha (CN); Sany Heavy Industry Co., Ltd., Changsha (CN)

( * ) Notice: Subject to any disclaimer, the term of this patent is extended or adjusted under 35 U.S.C. 154(b) by 652 days.

(21) Appl. No.: 13/634,417

(22) PCT Filed: Mar. 16, 2011

(86) PCT No.: PCT/CN2011/071872

§ 371 (c)(1),
(2), (4) Date: Sep. 12, 2012

(87) PCT Pub. No.: WO2011/113356

PCT Pub. Date: Sep. 22, 2011

(65) Prior Publication Data

US 2013/0004341 A1 Jan. 3, 2013

(30) Foreign Application Priority Data

Mar. 16, 2010 (CN) ..... 2010 1 0125240

(51) Int. Cl.
*F04B 15/02* (2006.01)
*F04B 7/00* (2006.01)
*F04B 9/113* (2006.01)

(52) U.S. Cl.
CPC ..... *F04B 15/02* (2013.01); *F04B 7/003* (2013.01); *F04B 9/113* (2013.01)

(58) Field of Classification Search
CPC ..... F04B 9/1172; F04B 9/1178; F04B 9/105; F04B 9/113; F04B 15/02; F04B 15/023
USPC ..... 92/13.4, 13.1, 13.6, 28; 91/41, 42, 43, 91/44, 45; 417/342, 317
See application file for complete search history.

(56) References Cited

U.S. PATENT DOCUMENTS 3,741,078 A * 6/1973 Johnson ..... 92/244
3,994,627 A * 11/1976 Calzolari ..... 417/317
(Continued)

FOREIGN PATENT DOCUMENTS

CN 2526541 Y 12/2002
CN 2881144 Y * 3/2007
(Continued)

OTHER PUBLICATIONS

Written Opinion for PCT/CN2011/071872, dated Jun. 16, 2011.

*Primary Examiner* — Devon Kramer
*Assistant Examiner* — Nathan Zollinger
(74) *Attorney, Agent, or Firm* — Bret E. Field; Bozicevic, Field & Francis LLP

(57) ABSTRACT

A concrete pumping structure and a control method thereof are disclosed. The concrete pumping structure includes a first pumping cylinder structure and a second pumping cylinder structure. Each pumping cylinder structure includes a delivery cylinder (1), a water tank (3) and a driving oil cylinder (7). The delivery cylinder (1) has a concrete piston assembly (2) inside, and during the pumping process, a piston rod (6) of the driving oil cylinder (7) drives the concrete piston assembly (2) to reciprocate in the delivery cylinder (1), and the water tank (3) is positioned between the delivery cylinder (1) and the driving oil cylinder (7). The concrete pumping structure also includes a concrete return hydraulic system, which controls the two driving oil cylinders (7) and drives the two concrete piston assemblies (2) to return back to the water tank (3) during returning the concrete.

20 Claims, 24 Drawing Sheets

(56) References Cited

U.S. PATENT DOCUMENTS

| | | | | |
|---|---|---|---|---|
| 4,455,921 | A * | 6/1984 | Griesbach | 91/191 |
| 6,299,416 | B1 * | 10/2001 | Kwag | 417/403 |
| 2007/0274850 | A1 * | 11/2007 | Muller et al. | 417/507 |

FOREIGN PATENT DOCUMENTS

| | | | | |
|---|---|---|---|---|
| CN | 200958466 | Y | | 10/2007 |
| CN | 201106590 | Y | * | 8/2008 |
| CN | 101793246 | A | | 8/2010 |

* cited by examiner

CONCRETE PUMPING STRUCTURE AND CONTROL METHOD THEREOF

The present application claims the priority to the Chinese invention patent application No. 201010125240.6 filed with the State Intellectual Property Office of the PRC on Mar. 16, 2010 and entitled "Concrete Pumping Structure and Control Method Thereof", which is incorporated herein by reference in its entirety.

FIELD OF THE INVENTION

The present invention relates to a concrete pumping structure and a control method thereof.

BACKGROUND OF THE INVENTION

The concrete pistons in concrete delivery apparatuses in contact with concrete are wearing parts and need to be replaced frequently. When the concrete delivery apparatuses are working, two concrete pistons reciprocate in a delivery cylinder one behind the other so as to continuously deliver the concrete, and when the concrete pistons need to be replaced, they must be returned back to a water tank connected with the delivery cylinder and a driving oil cylinder and then are disassembled and replaced. Thus, convenient disassembling and assembling of the concrete pistons should be taken into consideration during designing the structure of the concrete delivery apparatuses.

In existing concrete delivery apparatuses, only one concrete piston is returned back at one time, and there are three typical structures as follow:

The first one: in this structure, the concrete pistons are connected to an oil cylinder piston rod via an intermediate connection rod, and the intermediate connection rod can be connected to the concrete pistons and the oil cylinder piston rod via bolt or ferrule (see FIGS. 1 and 2). This structure comprises a delivery cylinder 101, a concrete piston assembly 102, a concrete piston connecting flange 103, an intermediate connection rod 104, a water tank 105, a left driving oil cylinder piston rod 106, (wherein the term "left" refers to the pumping cylinder structure in the upper parts of the figures) left driving oil cylinder rod chamber oil mouth 107, a left driving oil cylinder rod chamber 108, a left driving oil cylinder rod chamber oil feeding pipe 109, a left driving oil cylinder barrel 110, a left driving oil cylinder rodless chamber oil feeding pipe 111, a left driving oil cylinder piston 112, a left driving oil cylinder rodless chamber oil mouth 113, a right driving oil cylinder rodless chamber oil mouth 114, a right driving oil cylinder rodless chamber oil feeding pipe 115, a right driving oil cylinder rodless chamber 116, a right driving oil cylinder rod chamber oil feeding pipe 117, a right driving oil cylinder piston 118, a right driving oil cylinder rod chamber 119 and a right driving oil cylinder rod chamber oil mouth 20. The method and steps for replacing the concrete piston assembly 102 in the pumping mechanism as shown in FIGS. 1 and 2 are as follow: when the left driving oil cylinder concrete piston needs to be disassembled, the pressure oil of the hydraulic system enters the left driving oil cylinder rod chamber 108 through the left driving oil cylinder rod chamber oil mouth 107 and thus pushes the left driving oil cylinder piston 112 and the left driving oil cylinder piston rod 106 to retreat, the oil in the left driving oil cylinder enters the right driving oil cylinder rodless chamber 116 through the left driving oil cylinder rodless chamber oil mouth 113 and the right driving oil cylinder rodless chamber oil mouth 114 and thus pushes the right driving oil cylinder piston 118 forward, and when the left driving oil cylinder moves to the end, the intermediate connection rod 104 enters the water tank 105. Then the intermediate connection rod 104 can be disassembled, the left driving oil cylinder is operated to move the left driving oil cylinder piston rod 106 forward which then comes into contact with the concrete piston connection flange, and then a bolt is used to connect the left driving oil cylinder piston rod 106 with the concrete piston connecting flange, then the left driving oil cylinder is operated to retreat, so that the concrete piston assembly 102 returns back to the water tank and then the concrete piston assembly 102 can be replaced (as shown in FIG. 2). After the replacement is completed, the concrete piston can be restored in a reverse order. If the other concrete piston needs to be replaced, operation may be conducted in this order again. The difference lies in that the right driving oil cylinder concrete piston is operated to retreat. For this structure, only one concrete piston can be replaced at one time, and the operation takes much time and power and is of low efficiency.

The second one: as shown in FIGS. 3 and 4, the concrete pistons in this structure can be replaced and repaired more easily compared with the first structure, and in this structure a positioning sleeve is provided in the water tank between the delivery cylinder and the driving oil cylinder and is usually provided in the water tank in normal situations, thus the concrete pistons will come across the positioning sleeve when retreating and will not retreat to the water tank as it is positioned by the positioning sleeve. When the concrete pistons need to be replaced, it is only necessary to disassemble the positioning sleeve from the water tank, then the piston rod of the oil cylinder is able to further retreat a distance equal to the length of the positioning sleeve, and the concrete pistons are able to retreat to the water tank, which makes replacing the concrete pistons convenient. Compared with the first structure, the concrete pistons in this structure can be replaced more easily, but the positioning sleeve needs to be disassembled by man power during each replacement and only one concrete piston can be replaced at one time.

The third one: as shown in FIGS. 5 and 6, this structure is of high automation, the concrete pistons can be replaced and repaired very conveniently, and the piston at one side can automatically retreat to the water tank by just pressing a button. This structure is mainly achieved by providing a limit oil cylinder behind the driving oil cylinder, during normal usual operation, the limit oil cylinder is full of hydraulic oil and thus a closed chamber is formed, then the concrete pistons are not able to return back to the water tank as they are blocked by the limit oil cylinder, and when the concrete pistons need to be repaired or replaced, it is only necessary to start the button to get the oil in the limit oil cylinder back to the pressureless oil tank, then the concrete pistons will press the oil in the limit oil cylinder out when retreating and thus will further retreat a distance equal to the stroke of the limit oil cylinder, and then the concrete pistons are able to retreat to the water tank. Compared with the first and the second structures, the structure can be operated more simply and more conveniently, but it also has the shortcoming that only one concrete piston can be returned back at one time.

In conclusion, the concrete pumping structures and the control methods thereof in the prior art have problems such as low efficiency and repeated work in the regards of replacing and repairing the concrete pistons. To replace the two concrete pistons, one needs to be returned back and then the engine is shut down to release the system pressure, then the concrete piston is replaced; then the engine is started and the other concrete piston is returned back and replaced, thus the engine are started twice and shut down twice for per replacement, which takes long time and affects the construction efficiency of the concrete pump, thus improvements should be made. Especially, the two concrete pistons are used for the same period of time and have similar wear degrees, thus it would be significant to the replacement efficiency if they can be replaced at the same time.

SUMMARY OF THE INVENTION

The present invention aims to solve the technical problem of providing a concrete pump structure which can return back two concrete pistons at the same time, so as to improve the efficiency of returning back the concrete pistons.

The solution provided by the present invention is a concrete pumping structure comprising a first pumping cylinder structure and a second pumping cylinder structure, and each pumping cylinder structure comprises a delivery cylinder, a water tank and a driving oil cylinder; the delivery cylinder is provided with a concrete piston assembly inside, and during the pumping process, a piston rod of the driving oil cylinder drives the concrete piston assembly to reciprocate in the delivery cylinder, and the water tank is positioned between the delivery cylinder and the driving oil cylinder; the concrete pumping structure is characterized by further comprising a concrete return hydraulic system, which controls the two driving oil cylinders and drives the two concrete piston assemblies to return back to the water tank at the same time during returning the concrete. Therefore, returning back two concrete pistons at the same time can be realized, which notably improves the efficiency of replacing the concrete pistons. Preferably, the rodless chamber oil mouths of the two driving oil cylinders return oil at the same time during returning the concrete back. Thus oil return in the driving oil cylinders is realized in a simple way during returning the concrete back.

Preferably, each pumping cylinder structure also comprises a limit structure, and during the pumping process, the limit structure conducts limiting and restricts the concrete piston assembly from returning back to the water tank, and removes the limiting during the returning of the concrete and allows the concrete piston assembly to return back to the water tank.

The concrete return hydraulic system comprises a concrete return valve assembly and at least one pressure oil source, and the concrete return valve assembly controls the at least one pressure oil source, when the limit structure has removed the limiting, oil is supplied to the rod chamber oil mouths of the two driving oil cylinders via a concrete return pipeline at the same time, and the oil is returned to the rodless chamber oil mouths of the two driving oil cylinders at the same time. Thus, the two concrete pistons are returned back at the same time by supplying oil to the rod chamber oil mouths of the driving oil cylinders and returning the oil to the rodless chamber oil mouths of the driving oil cylinders at the same time, which notably improves the efficiency of replacing the concrete pistons.

According to an improved solution of the present invention, the limit structure comprises a concrete return auxiliary cylinder located at the end of or in the driving oil cylinder, and the concrete return valve assembly controls the concrete return auxiliary cylinder to feed oil or return oil via the auxiliary cylinder oil mouth of the concrete return auxiliary cylinder and switches between a normal pumping working state and a limiting removed state. The concrete return auxiliary cylinder is provided with a piston therein, the driving oil cylinder is provided with a concrete return rod at the side facing the concrete return auxiliary cylinder, and limiting is achieved via the concrete return rod and the piston of the concrete return auxiliary cylinder.

In the situation that the limit structure comprises the concrete return auxiliary cylinder, if the concrete return valve assembly only controls the concrete return pipeline, a control valve assembly similar to the concrete return valve assembly may be additionally provided at the auxiliary cylinder oil mouth of the concrete return auxiliary cylinder, for example, a combination of the reversing valve of a two-position four-way valve and a one-way valve, then the working oil mouth of the reversing valve is connected to the auxiliary cylinder oil mouth, the oil inlet of the reversing valve is connected to the oil outlet of the one-way valve, the oil inlet of the one-way valve is connected to the pressure oil source, and the oil outlet of the reversing valve is connected to an oil return tank. Through arranging the control valve assembly, oil is supplied to the auxiliary cylinder oil mouth of the concrete return auxiliary cylinder during operation, the rear chamber of a concrete return auxiliary piston is locked by way of the locking effect of the one-way valve, oil is returned to the auxiliary cylinder oil mouth during returning the concrete back, and the concrete is returned back by moving the concrete return rod of the driving oil cylinder piston backward on the top.

Most preferably, the concrete return pipeline and the auxiliary cylinder oil mouth are both connected with the concrete return valve assembly. Then there can be many embodiments, for example, the concrete return valve assembly comprises at least one reversing valve and at least one one-way valve. Thus it is achieved that oil enters two rod chamber oil mouths only during returning the concrete back while oil will not return to the rod chamber oil mouths during the operation.

Now a specific embodiment of the concrete return valve assembly is as follows: the concrete return valve assembly comprises a first one-way valve, a first reversing valve and a second one-way valve; the oil outlet of the first one-way valve is connected to the concrete return pipeline, one working oil mouth of the first reversing valve is connected to the oil inlet of the first one-way valve, the other working oil mouth of the first reversing valve is connected to the two auxiliary cylinder oil mouths, and the oil inlet of the first reversing valve is connected with the oil outlet of the second one-way valve and is thus connected to a first pressure oil source and the oil outlet of the first reversing valve is connected to the oil return tank. Thus, the locking effect of the first one-way valve ensures that the oil cannot be returned back through the concrete return pipeline during normal operation, and the second one-way valve ensures that oil is supplied through the auxiliary cylinder oil mouth during normal operation so as to lock the rear chamber of the concrete return auxiliary piston. Meanwhile, it is also ensured that oil is supplied to the concrete return pipeline during returning the concrete back, and oil is discharged to the oil return tank through the auxiliary cylinder oil mouth during returning the concrete back.

Now another alternative specific embodiment of the concrete return valve assembly is as follow: the concrete return valve assembly comprises a first hydraulic control one-way valve, a first reversing valve, a second one-way valve and a second reversing valve; the oil outlet of the first hydraulic control one-way valve is connected to the concrete return pipeline, the oil inlet and the control oil mouth of the first hydraulic control one-way valve are respectively connected to the two working oil mouths of the second reversing valve, the oil return mouth of the second reversing valve is connected to the oil return tank and the oil inlet of the second reversing valve is connected to a working oil mouth of the first reversing valve, the other working oil mouth of the first reversing valve is connected to the two auxiliary cylinder oil mouths, and the oil inlet of the first reversing valve is connected with the oil outlet of the second one-way valve and thus is connected to the first pressure oil source and the oil return mouth of the first reversing valve is connected to the oil return tank. The first hydraulic control one-way valve is substantially functionally identical with the first one-way valve in the previous embodiment, and their difference lies in that during returning the concrete back, oil can be injected into the control oil mouth of the first hydraulic control valve through the reversing of the second reversing valve after returning the two concrete pistons back to the water tank by supplying oil to the concrete return pipeline, thus the oil in the concrete return pipeline and the driving oil cylinder rod chamber may be returned back. In another specific embodiment, the first one-way valve and the second reversing valve may be integrated as one valve.

According to another improved solution of the present invention, the limit structure comprises a positioning sleeve additionally provided in the water tank, and the positioning sleeve can restrict the concrete piston assembly from returning back to the water tank during operation and can be disassembled during returning back the concrete so as to allow the concrete piston assembly to return back to water tank. Then the concrete return valve assembly only controls the concrete return pipeline, according to a specific embodiment of the concrete return valve assembly, now, for example, the concrete return valve assembly is a combination of the reversing valve of a two-position four-way valve and a one-way valve, the working oil mouth of the reversing valve is connected to the oil inlet of the one-way valve, the concrete return pipeline is connected to the oil outlet of the one-way valve, the oil inlet of the reversing valve is connected to a pressure oil source, and the oil outlet of the reversing valve is connected to the oil return tank. Thus, it is achieved that oil is supplied to two rod chamber oil mouths at the same time only during returning back the concrete and the oil cannot be returned back through the concrete return pipeline due to locking effect of the one-way valve during the operation. Another embodiment of the concrete return valve assembly is that the concrete return valve assembly comprises a first one-way valve, a first reversing valve and a second reversing valve; the working oil mouth of the second reversing valve is connected to the oil inlet of the one-way valve, the oil outlet of the one-way valve is connected to the concrete return pipeline, and the oil inlet of the second reversing valve is connected to the working oil mouth of the first reversing valve, the oil inlet of the first reversing valve is connected to the pressure oil source and the oil outlets of the first reversing valve and the second reversing valve are both connected to the oil return tank. In another specific embodiment, the first one-way valve and the second reversing valve may be integrated as one valve.

According to a preferable embodiment of the present invention, a second valve assembly is contained, and the oil is returned back through the rodless chamber oil mouth of the driving oil cylinder under the control of the second valve assembly during returning back the concrete. The second valve assembly provides the possibility of using the second valve assembly to simultaneously return oil during returning back the concrete and supply oil during operation so as to drive the driving oil cylinder.

According to a preferable embodiment of the present invention, the rod chambers of the driving oil cylinders are in communication with each other, and the rodless chamber oil mouths of the driving oil cylinders are controlled by the second valve assembly so that oil is supplied through one rodless chamber oil mouth and oil is returned back through the other rodless chamber oil mouth during operation. Thus switching can be made between a working state and a concrete returning state in a simple way. In the normal working state, oil is supplied through one rodless chamber oil mouth, as the rod chambers of the driving oil cylinders are in communication with each other, oil can be returned through the other rodless chamber oil mouth, then it can be achieved that one of the two pumping cylinder structures absorbs material while the other one sprays the material. Now although the concrete return pipeline is connected with the rod chamber oil mouths of the driving oil cylinders, oil cannot be supplied via the concrete return pipeline to the rod chamber oil mouths or oil cannot be returned back via the concrete return pipeline from the rod chamber oil mouths. The rodless chambers of the driving oil cylinders may also be made to communicate with each other, oil is injected into one of the rod chamber oil mouths of the driving oil cylinders, oil is returned back through the other rod chamber oil mouth, and one of the pumping cylinder structures absorbs material while the other sprays the material. Then to return the concrete back, the above solution may be adjusted correspondingly, for example, oil is also supplied to the rod chamber oil mouths via the concrete return pipeline during returning the concrete back, while oil is neither supplied nor returned during operation, and oil is returned back through the two rodless chamber oil mouths during returning back the concrete.

According to a preferable embodiment of the present invention, the second valve assembly comprises a third reversing valve and an overflow unloading valve.

According to a preferable embodiment of the present invention, the rodless chamber oil mouths are respectively connected to the two working oil mouths of the third reversing valve, and the oil inlet of the third reversing valve is connected to a second pressure oil source. Preferably, the overflow unloading valve is connected between the third reversing valve and the second pressure oil source at one side, and connected to the oil return tank at the other side. Preferably, the overflow unloading valve is a cartridge type overflow unloading valve. The cartridge type overflow unloading valve comprises a cartridge valve and an electric control valve which controls the opening and closing of the cartridge valve. Thus, during the working situation, the electric control valve can control the cartridge valve and keep it closed, so that the overflow unloading valve is used as a normal overflow valve, oil cannot be returned to the oil return tank through the two rodless chamber oil mouths, and during returning back the concrete, the electric control valve can control the cartridge valve and keep it open all the time, then oil is returned back to the oil return tank through the two rodless chamber oil mouths.

The first pressure oil source is an accumulator or an oil pump. The second pressure oil source is an accumulator or an oil pump. They may be other pressure oil sources.

The concrete return auxiliary cylinder can be connected to the end of the driving oil cylinders or embedded into the driving oil cylinders, as long as the concrete return auxiliary cylinder can achieve the above auxiliary function of returning back the concrete.

The concrete return auxiliary piston is restricted at a working position by a blocking part provided in the concrete return auxiliary cylinder. The stop, for example can be a clamp ring.

Preferably, the first reversing valve and the second reversing valve can be an electromagnetic reversing valve or hydraulic dynamic valve, and the third reversing valve can be an electromagnetic reversing valve, an electro-hydraulic valve or an electromagnetic valve controlled cartridge valve assembly. Switching can be made between the working state and the concrete returning state under electric control by providing the electric control reversing valves, thus the automation of returning the concrete back is notably improved.

The present invention also relates to a corresponding control method for a concrete pumping structure, comprising normal pumping control and concrete return control, which is characterized in that the concrete return control comprises the following steps: a) controlling a concrete return valve assembly, and supplying oil to the rod chamber oil mouths of two driving oil cylinders at the same time; and b) controlling a second valve assembly, so that oil is returned through the rodless chamber oil mouths of the driving oil cylinders at the same time; the piston rods of the driving oil cylinders bringing two concrete piston assemblies to return back to the water tank at the same time. Preferably, it also comprises a step c) which is conducted before step a) or at the same with step a) for removing the limiting function of the limit structure.

In one embodiment, the limit structure comprises a concrete return auxiliary cylinder located at the end of or within the driving oil cylinders, and the concrete return valve assembly controls returning the oil through the auxiliary cylinder oil mouth of the concrete return auxiliary cylinder so as to realize the steps, and controls supplying oil through the auxiliary cylinder oil mouth to switch to a pumping operation state. In another embodiment, the limit structure comprises a positioning sleeve additionally provided within the water tank, and the step c) is realized before the step a) by disassembling the positioning sleeve.

The present invention can return back double concrete pistons at the same time and thus greatly improves the efficiency of returning back the concrete pistons. The two concrete pistons can be made to automatically return back to the water tank simultaneously at one time by just pressing a control button corresponding to the concrete return valve assembly of the concrete return pipeline, making the sealed replacing and repairing of the concrete pistons, the delivery cylinder and the driving oil cylinders faster and more convenient and greatly saving the time of replacing the concrete pistons.

BRIEF DESCRIPTION OF THE DRAWINGS

The present invention will be further described hereinafter in combination with the accompanying drawings and the embodiments thereof.

FIGS. 10 and 11 show the fourth and the fifth specific embodiments of the concrete pumping structure of the present invention; wherein FIGS. 12*a*, 13*a* and 14*a* show the sixth, the seventh and the eighth specific embodiments of the concrete pumping structure of the present invention, wherein

DETAILED DESCRIPTION OF THE PRESENT INVENTION

Figure 1:
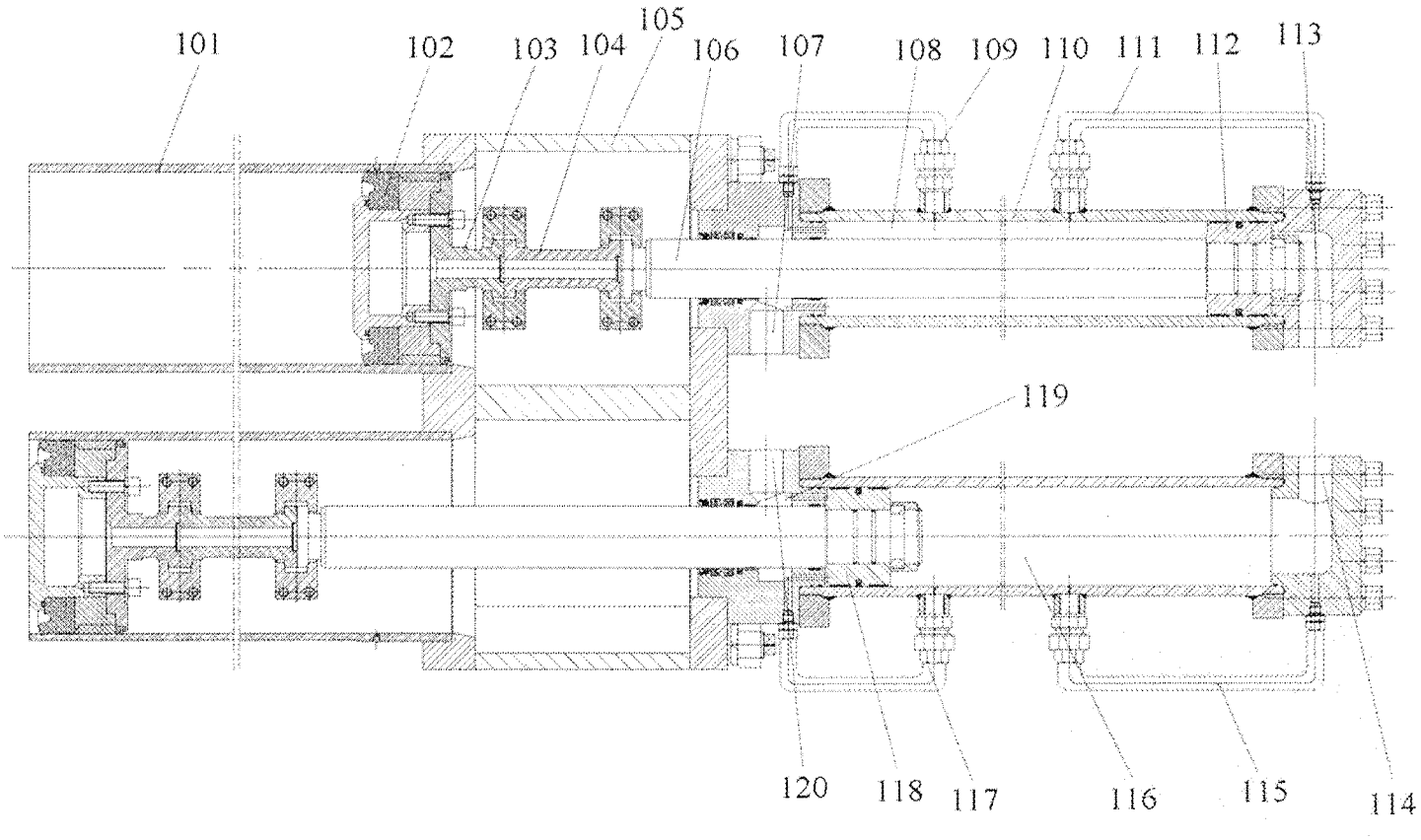
FIGS. 1 and 2 respectively show the working state and the concrete returning state of the first concrete return solution in the prior art.
Figure 2:
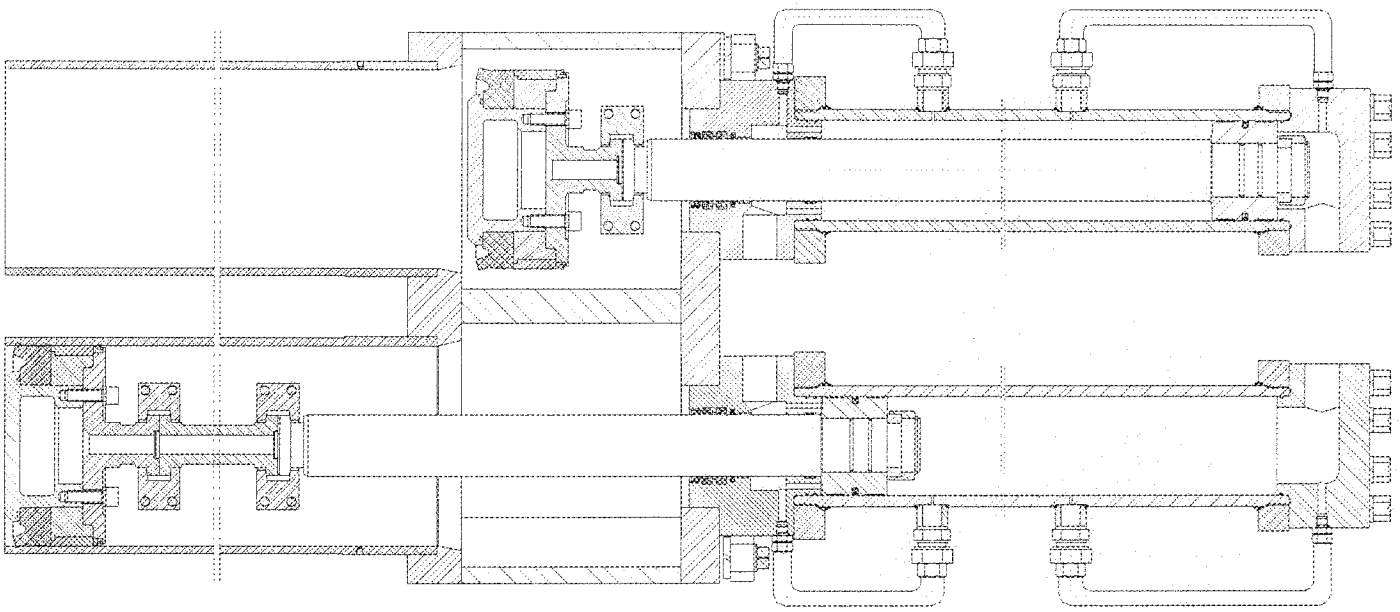
Figure 3:
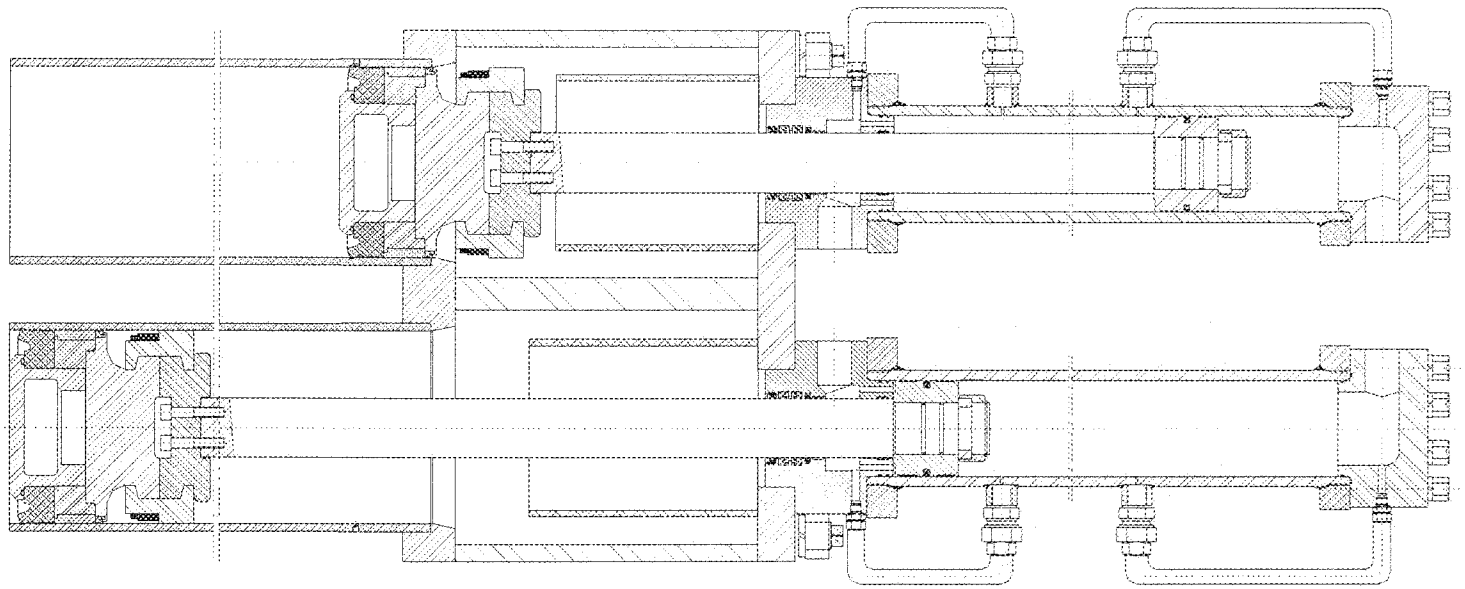
FIGS. 3 and 4 respectively show the working state and the concrete returning state of the second concrete return solution in the prior art.
Figure 4:
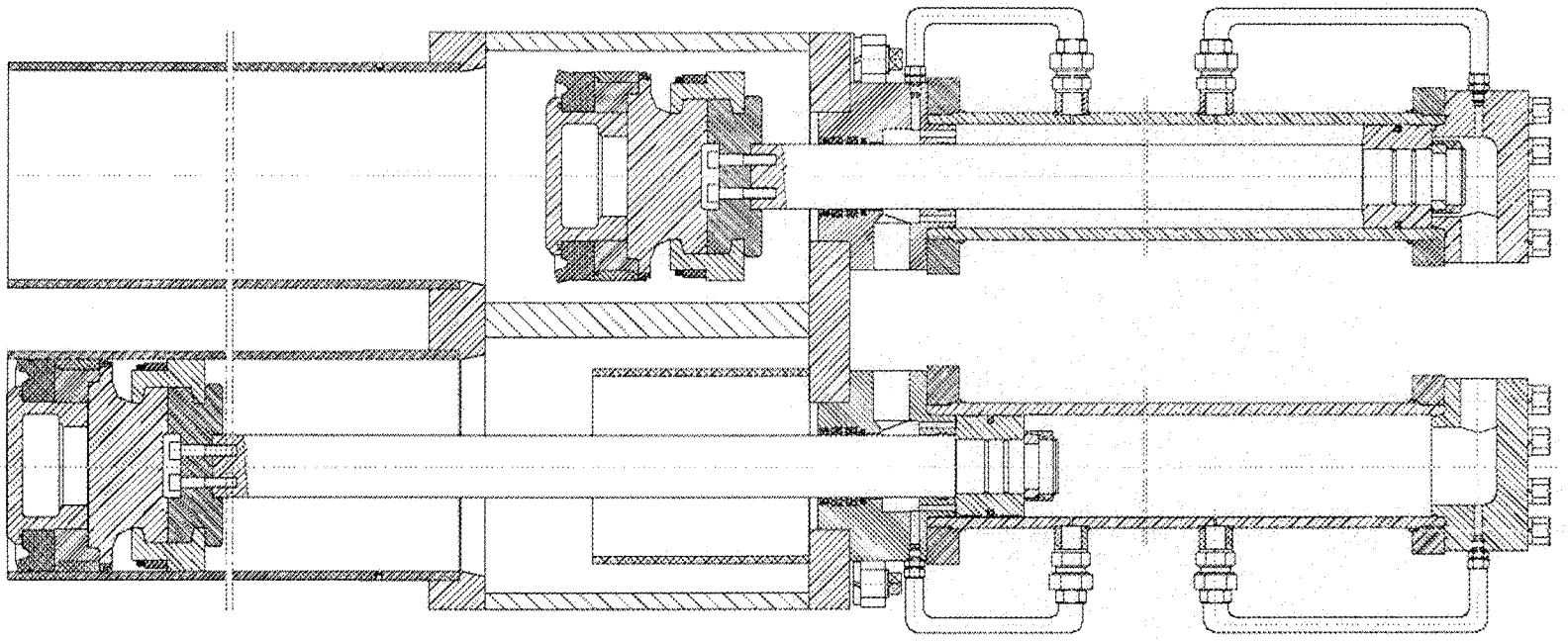
Figure 5:
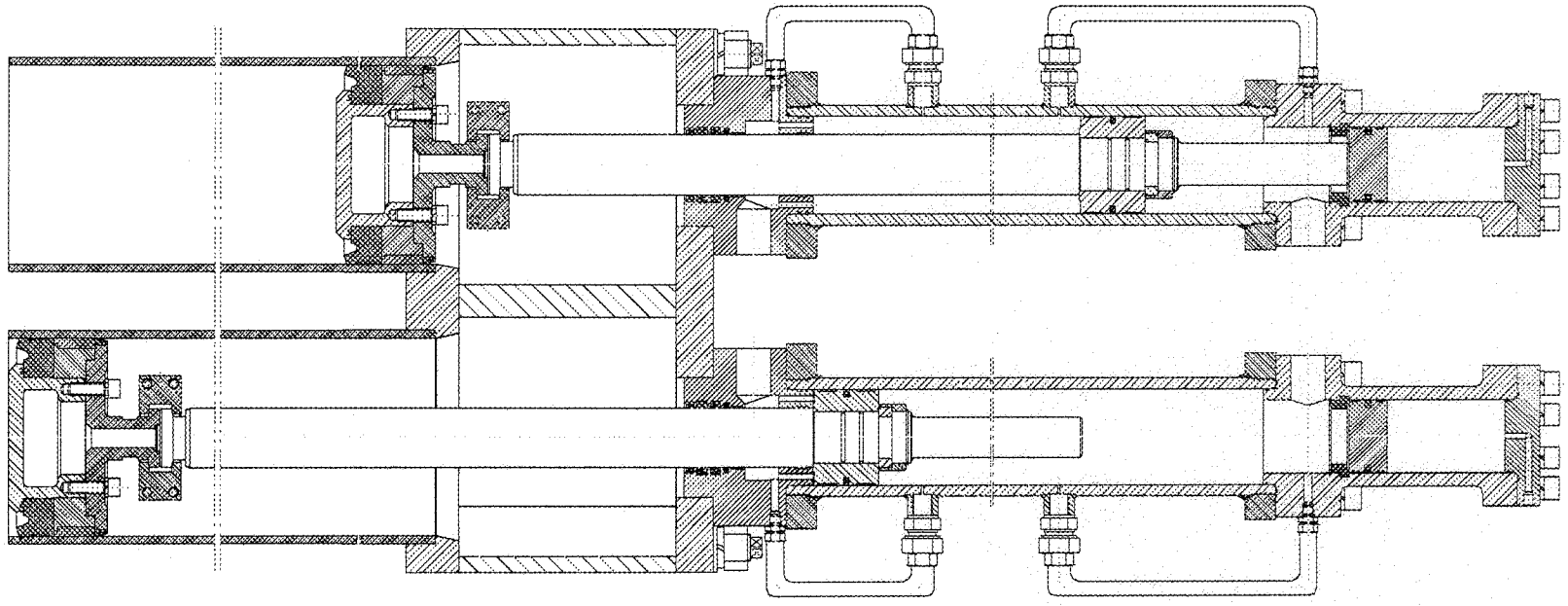
FIGS. 5 and 6 respectively show the working state and the concrete returning state of the third concrete return solution in the prior art.
Figure 6:
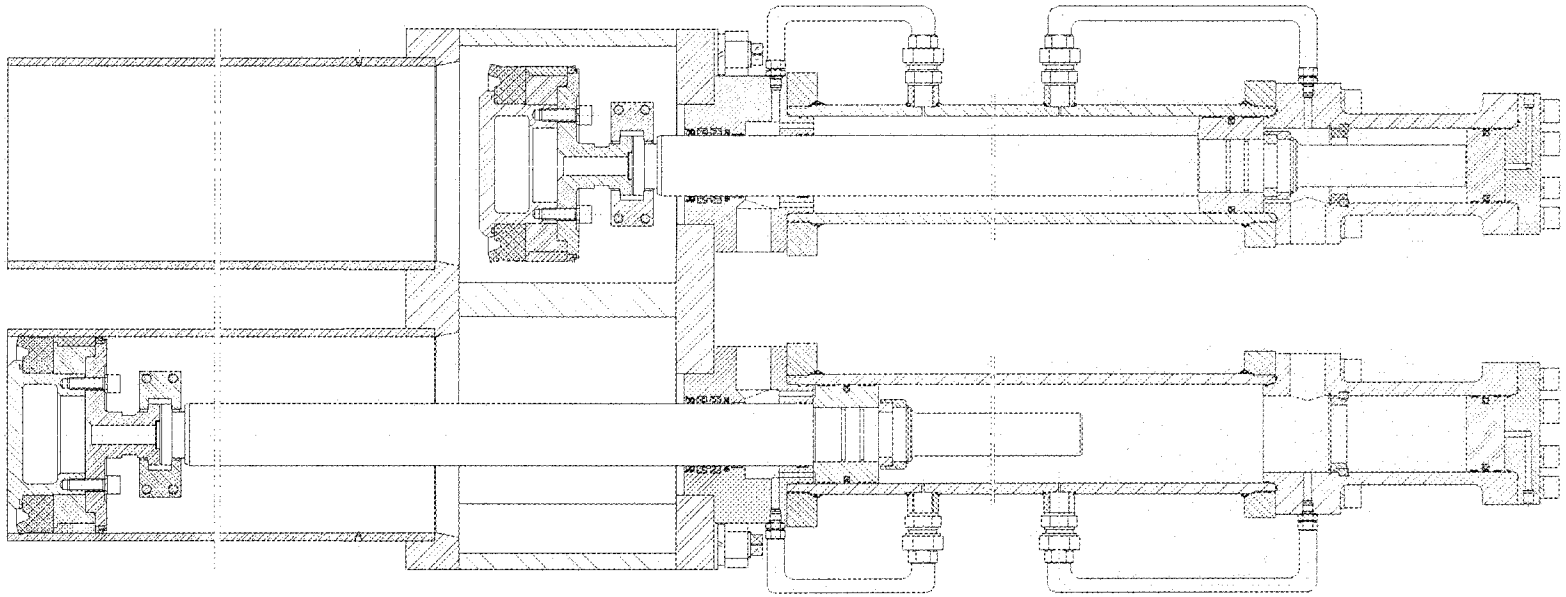
Figure 7A:
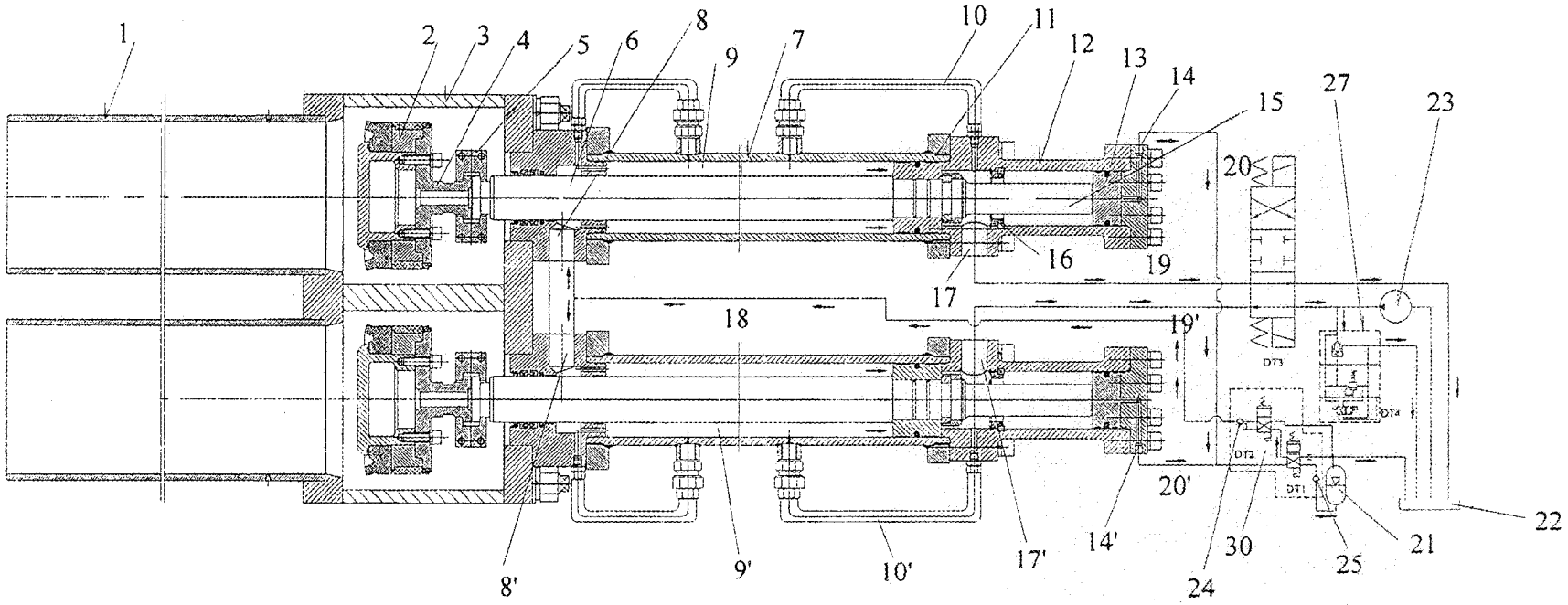
FIG. 7*a* shows the first specific embodiment of the concrete pumping structure of the present invention.
Figure 7B:
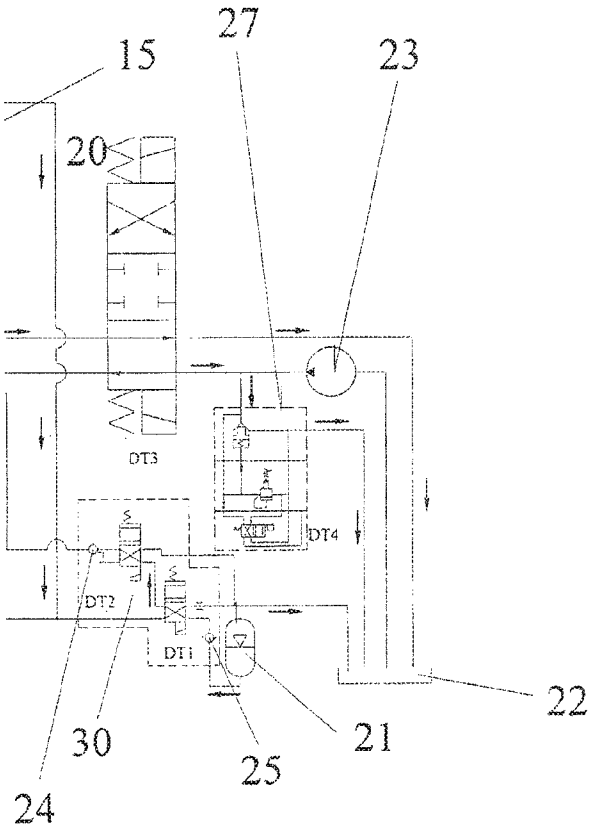
FIG. 7*b* shows an enlarged view of a corresponding hydraulic element.

FIG. 7 shows the first specific embodiment of the concrete pumping structure of the present invention, as the present invention aims to solve the problem of the returning back the concrete, only the view of the concrete returning state is shown.

The concrete pumping structure of the present invention comprises a first pumping cylinder structure and a second pumping cylinder structure which have the same structure. One pumping cylinder structure (in the upper part of the figure) in the pumping structure comprises a delivery cylinder 1, a concrete piston assembly 2, a water tank 3, a concrete piston connecting flange 4, a clamp 5, a driving oil cylinder piston rod 6, a driving oil cylinder 7, a rod chamber oil mouth 8 of the driving oil cylinder, a rod chamber 9 of the driving oil cylinder, an oil feeding pipe 10, a driving oil cylinder piston 11, a concrete return auxiliary cylinder 12, a concrete return auxiliary piston 13, an auxiliary cylinder oil mouth 14, a concrete return rod 15, a blocking part 16 in the concrete return auxiliary cylinder 12, and a rodless chamber oil mouth 17 of the driving oil cylinder. The components of the other pumping cylinder structure are also indicated with similar reference numerals, and the difference lies in that the reference numerals are marked with the symbol "'" and thus are not marked in the part of Reference numerals any more.

Wherein the driving oil cylinder piston rod 6 in the driving oil cylinder 7 is directly connected with the concrete piston assembly 2 in the delivery cylinder 1 via the concrete piston connecting flange 4 and the clamp 5. The driving oil cylinder 7 is controlled to reciprocate. As the present invention focuses on the improvement in returning back the concrete, how the driving oil cylinder 7 is controlled by a concrete pump reversing controlling device (not shown) in normal situations to reciprocate will not be detailed here. Wherein the concrete return auxiliary cylinder 12 can be connected to the end of or embedded into the driving oil cylinder 7 as shown in FIG. 7, the concrete return auxiliary piston 13 can move retractably in the concrete return auxiliary cylinder 12 by supplying oil or returning oil through the auxiliary cylinder oil mouth 14, 14'; and the driving oil cylinder piston 11 is provided with the concrete return rod 15 at a side facing the concrete return auxiliary cylinder 12.

In other words, in the first, the second and the third specific embodiments, the concrete return auxiliary cylinder 12 and the concrete return auxiliary piston 13 provided therein constitute the limit structure which restricts the concrete piston assembly 2 from returning back to the water tank 3 during the operation. The concrete return auxiliary cylinder 12 is provided therein with a movable concrete return auxiliary piston 13 which conducts limiting during operation by supplying oil through the auxiliary cylinder oil mouth 14, 14' and restricts the concrete piston assembly 2 from returning back to the water tank 3 or restricts oil return to remove the limiting during returning back the concrete and then allow the concrete piston assembly 2 to return back to the water tank 3. Limiting is achieved by the concrete return rod 15 and the concrete return auxiliary piston 13, wherein the concrete return rod 15 is connected to the driving oil cylinder piston 11 and conducts limiting during operation by supporting the concrete return auxiliary piston 13.

The present invention also comprises a concrete return hydraulic system comprising a concrete return valve assembly 30 and at least one pressure oil source 21, 23, and the concrete return valve assembly controls the at least one pressure oil source, when the limit structure is in a limiting removed state, oil is supplied to the rod chamber oil mouths of the two driving oil cylinders at the same time via the concrete return pipeline, oil is returned through the rodless chamber oil mouths of the two driving oil cylinders, and during returning back the concrete, the concrete return hydraulic system controls the two driving oil cylinders 7 and then brings the two concrete piston assemblies 2 to return back to the water tank 3 at the same time. The concrete return pipeline 18 is controllably connected with the rod chamber oil mouths 8, 8' of the driving oil cylinders 7, 7' in a way that oil is supplied to the rod chamber oil mouths 8, 8' at the same time during returning back the concrete. Thus the concrete piston assemblies 2, 2' can be returned back to the water tank and then replaced and repaired, and meanwhile, the seal of the delivery cylinder and the driving oil cylinders can be replaced. At the same time, oil is returned through the rodless chamber oil mouths 17, 17' of the driving oil cylinders 7, 7'.

In this embodiment, oil is supplied to the rod chamber oil mouths 8, 8' through the concrete return pipeline 18 at the same time during returning back the concrete, while oil will not be returned back through the concrete return pipeline in the normal working state. The concrete return valve assembly 30 comprises a first hydraulic control one-way valve 24, a first reversing valve DT1, a second one-way valve 25 and a second reversing valve DT2; the oil outlet of the first hydraulic control one-way valve 24 is connected to the concrete return pipeline 18, the oil inlet and the control oil mouth of the first hydraulic control one-way valve 24 are respectively connected to the two working oil mouths of the second reversing valve DT2, the oil return mouth of the second reversing valve DT2 is connected to an oil return tank 22 and the oil inlet of the second reversing valve DT2 is connected to a working oil mouth of the first reversing valve DT1, the other working oil mouth of the first reversing valve DT1 is connected to the two auxiliary cylinder oil mouths 14, 14', and the oil inlet of the first reversing valve DT1 is connected with the oil outlet of the second one-way valve 25 and thus is connected to the first pressure oil source 21 and the oil return mouth of the first reversing valve DT1 is connected to the oil return tank 22. The first pressure oil source 21 is an accumulator and can also be other pressure oil sources such as an oil pump.

In this embodiment the first reversing valve DT1 and the second reversing valve DT2 are electromagnetic two-position four-way valves.

In the working state, the working oil mouth of the first reversing valve DT1 connected to the pipeline 20, 20' of the auxiliary cylinder oil mouths 14, 14' is connected with the oil inlet of the first reversing valve DT1, and the working oil mouth of the first reversing valve DT1 connected to the oil inlet of the second reversing valve DT2 is connected with the oil outlet of the first reversing valve DT1.

In the concrete returning state, the working oil mouth of the first reversing valve DT1 connected to the pipeline 20, 20' of the auxiliary cylinder oil mouths 14, 14' is connected with the oil outlet of the first reversing valve DT1, and the working oil mouth of the first reversing valve DT1 connected to the oil inlet of the second reversing valve DT2 is connected with the oil inlet of the first reversing valve DT1.

In the working state, the working mouth of the second reversing valve DT2 connected to the oil inlet of the first one-way valve 24 is connected with the oil outlet of the second reversing valve DT2, and the working mouth of the second reversing valve DT2 connected to the control oil mouth of the first one-way valve 24 is connected with the oil inlet of the second reversing valve DT2.

In the concrete returning state, the working mouth of the second reversing valve DT2 connected to the oil inlet of the first one-way valve 24 is connected with the oil inlet of the second reversing valve DT2, and the working mouth of the second reversing valve DT2 connected to the control oil mouth of the first one-way valve 24 is connected with the oil outlet of the second reversing valve DT2.

The locking effect of the first one-way valve 24 ensures that the oil cannot be returned back through the concrete return pipeline 18 during normal operation, and oil can be supplied through the concrete return pipeline 18 during returning back the concrete. Meanwhile, the second one-way valve 25 ensures that oil is supplied through the auxiliary cylinder oil mouth during normal operation so as to lock the rear chamber of the concrete return auxiliary piston 13, then the rear chamber is full of pressure oil which will not return back due to the second one-way valve 25, thereby locking the concrete return auxiliary piston 13 at the blocking part 16, providing limiting protection during the normal operation in case of an extended stroke for possible malfunctions, for example, the reversing controlling mechanism of the driving oil cylinder piston 11 fails, and preventing the concrete piston assemblies 2, 2' from returning back to the water tank 3 during the normal operation. During returning back the concrete, oil is discharged to the oil return tank through the auxiliary cylinder oil mouths 14, 14', and the concrete is returned back by moving the concrete return rod of the driving oil cylinder pistons 6, 6' backward on the top.

Oil is returned back at the same time through the rodless chamber oil mouths 17, 17' of the driving oil cylinders 7, 7' under the control of the second valve assembly during returning the concrete back. The second valve assembly comprises a third reversing valve DT3 and an overflow unloading valve 27. The rodless chamber oil mouths 17, 17' are respectively connected to the two working oil mouths of the third reversing valve DT3, and the oil inlet of the third reversing valve is connected to a second pressure oil source 23. The overflow unloading valve 27 is connected between the third reversing valve DT3 and the second pressure oil source 23 at one side, and connected to the oil return tank 22 at the other side. The second pressure oil source 23 is an accumulator or an oil pump.

In this embodiment, the rod chambers 9, 9' of the driving oil cylinders 7, 7' are in communication with each other, and the rodless chamber oil mouths 17, 17' of the driving oil cylinders 7, 7' are controlled by the third reversing valve DT3 and the overflow unloading valve 27 so that oil is supplied through one of the rodless chamber oil mouth and oil is returned back through the other rodless chamber oil mouth during the operation. In the concrete returning state, oil is returned back through the two rodless chamber oil mouths 17, 17'. As shown in the figures, in the working state, when the control valve DT4 is powered, the cartridge valve is closed, the overflow unloading valve 27 is used as a normal overflow valve, only when the system pressure exceeds a predetermined pressure, the cartridge valve is opened and the overflow unloading valve overflows. In the concrete returning state, i.e., the control valve DT4 is not powered, the cartridge valve is opened all the time, the hydraulic system directly unloads. Thus, oil is returned back through both of the two rodless chamber oil mouths 17, 17'. Thus, switching can be made between a working state and a concrete returning state in a simple way.

Further, in the normal working state, oil is supplied through one rodless chamber oil mouth, as the rod chambers 9, 9' of the driving oil cylinders 7, 7' are in communication with each other, oil can be returned through the other rodless chamber oil mouth, then it can be achieved that one of the two pumping cylinder structures absorbs material while the other one sprays the material. Now although the concrete return pipeline 18 is connected with both of the rod chamber oil mouths 8, 8' of the driving oil cylinders 7, 7', oil cannot be supplied via the concrete return pipeline 18 to the rod chamber oil mouths or oil cannot be returned back via the concrete return pipeline 18 from the rod chamber oil mouths. Thus, the concrete return pipeline will not affect the normal pumping process. The rodless chambers of the driving oil cylinders may also be made to communicate with each other, oil is injected into one of the rod chamber oil mouths of the driving oil cylinders, oil is returned back through the other rod chamber oil mouth, and normal operation is achieved, now, to return back the concrete, the above solution may be adjusted correspondingly, for example, oil is also supplied to the rod chamber oil mouths at the same time via the concrete return pipeline during returning the concrete back, while oil is neither supplied nor returned during operation, and oil is returned back through the two rodless chamber oil mouths during the oil return.

The third reversing valve DT3 in the second valve assembly can decide the rodless chamber oil mouth through which oil is supplied during the normal operation, and then correspondingly oil is returned through the other rodless chamber oil mouth.

The operation of the above concrete pumping structure, which can return back double concrete pistons at the same time, is as follow: when the two concrete pistons need to be returned back at the same time, hydraulic oil is supplied through the rod chamber oil mouths 8, 8' of the two driving oil cylinders 7, 7' at the same time and the rodless chambers of the two driving oil cylinders are also connected into the pressureless oil tank, the auxiliary oil mouths 14, 14' of the two concrete return auxiliary cylinders 12, 12' are also connected to the oil tank, now the two driving oil cylinder pistons and the piston rods retreat at the same time due to the oil pressure, then the piston rods will support the concrete return auxiliary pistons in the concrete return auxiliary cylinders, thus the two concrete pistons connected with the two driving oil cylinder piston rods will return back to the water tank from the delivery cylinder at the same time, and then the seal of the two concrete pistons and the delivery cylinder can be replaced.

Figure 8A:
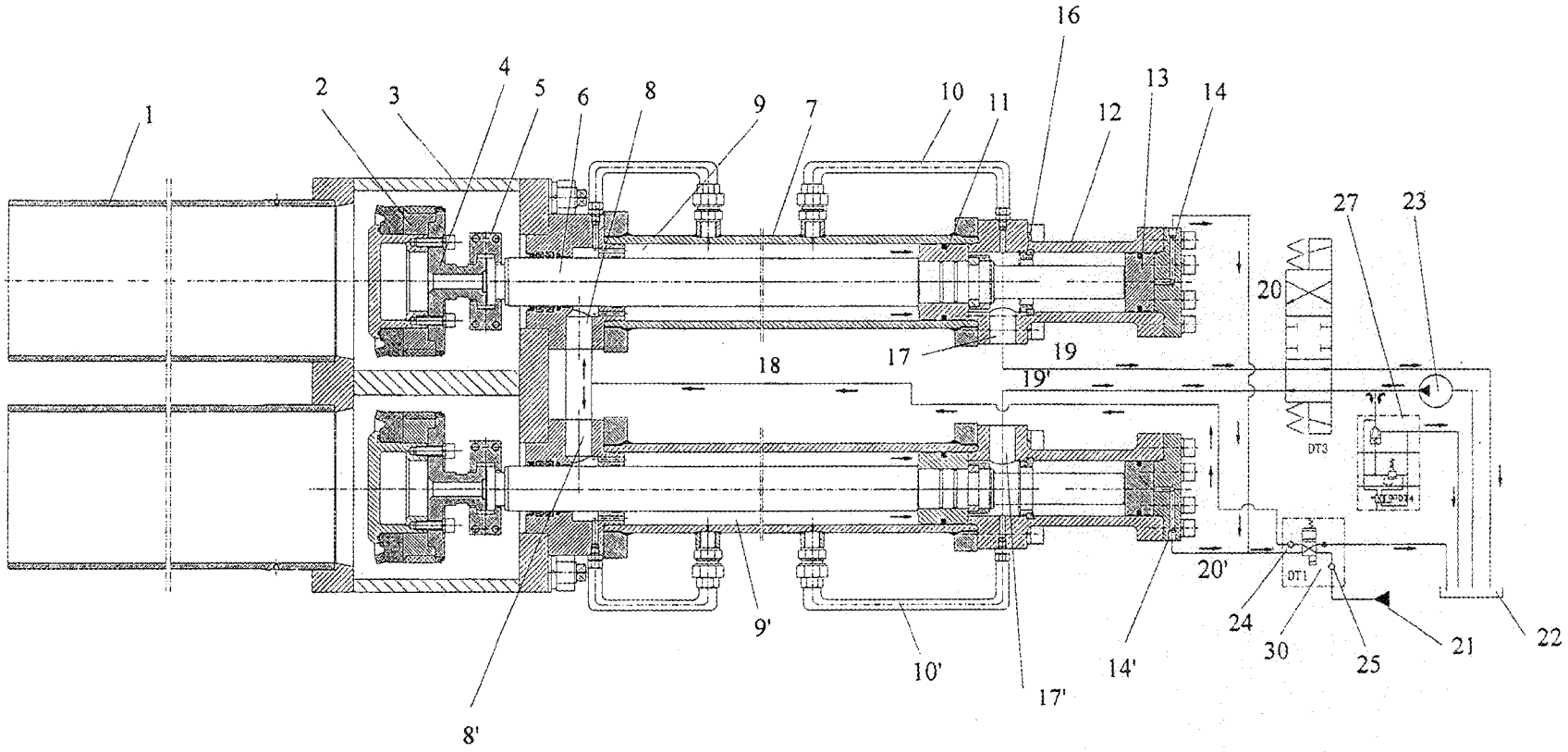
FIG. 8*a* shows the second specific embodiment of the concrete pumping structure of the present invention.
Figure 8B:
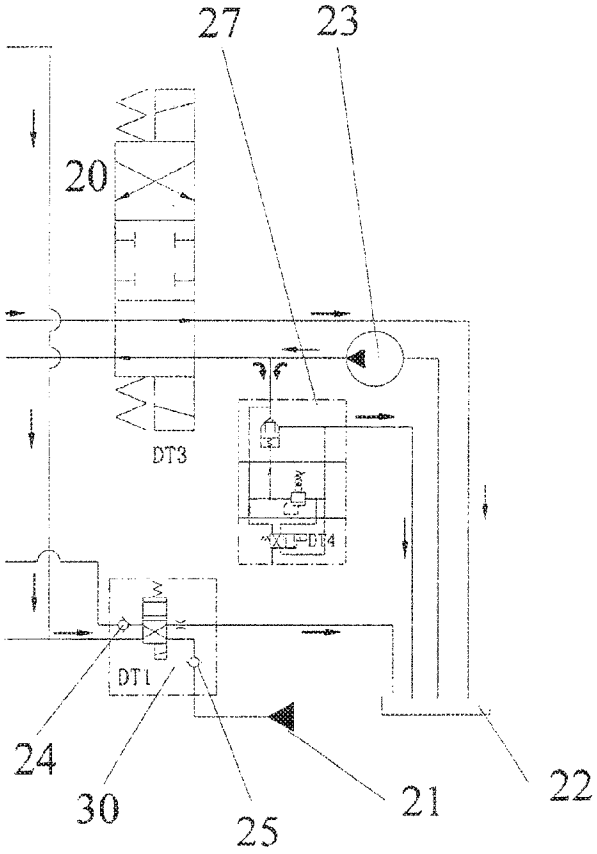
FIG. 8*b* shows an enlarged view of a corresponding hydraulic element.

FIG. 8 shows the second specific embodiment of the concrete pumping structure of the present invention. The only difference with the first specific embodiment lies in the design of the concrete return valve assembly 30. The concrete return valve assembly comprises a first one-way valve 24, a first reversing valve DT1 and a second one-way valve 25; the oil outlet of the first one-way valve 24 is connected to the concrete return pipeline 18, one working oil mouth of the first reversing valve DT1 is connected to the oil inlet of the first one-way valve 24 and the other working oil mouth is connected to the two auxiliary cylinder oil mouths 14, 14', and the oil inlet of the first reversing valve DT1 is connected with the oil outlet of the second one-way valve 25 and thus connected to the first pressure oil source 21, and the oil outlet of the first reversing valve DT1 is connected to the oil return tank 22.

In the working state, the working oil mouth of the first reversing valve DT1 connected to the pipeline 20, 20' of the auxiliary cylinder oil mouths 14, 14' is connected with the oil inlet of the first reversing valve DT1, and the working oil mouth of the first reversing valve DT1 connected to the oil inlet of the first one-way valve 24 is connected with the oil outlet of the first reversing valve DT1.

In the concrete returning state, the working oil mouth of the first reversing valve DT1 connected to the pipeline 20, 20' of the auxiliary cylinder oil mouths 14, 14' is connected with the oil outlet of the first reversing valve DT1, and the working oil mouth of the first reversing valve DT1 connected to the oil inlet of the first one-way valve 24 is connected with the oil inlet of the first reversing valve DT1.

The difference between the first hydraulic control one-way valve 24 in FIG. 7 and the first one-way valve in FIG. 8 lies in that during returning back the concrete, after supplying oil to the concrete return pipeline so as to return the two concrete pistons back to the water tank, oil can be injected to the control oil mouth of the first hydraulic control valve through the reversing of the second reversing valve DT2, thus the oil in the concrete return pipeline may be returned.

Figure 9A:
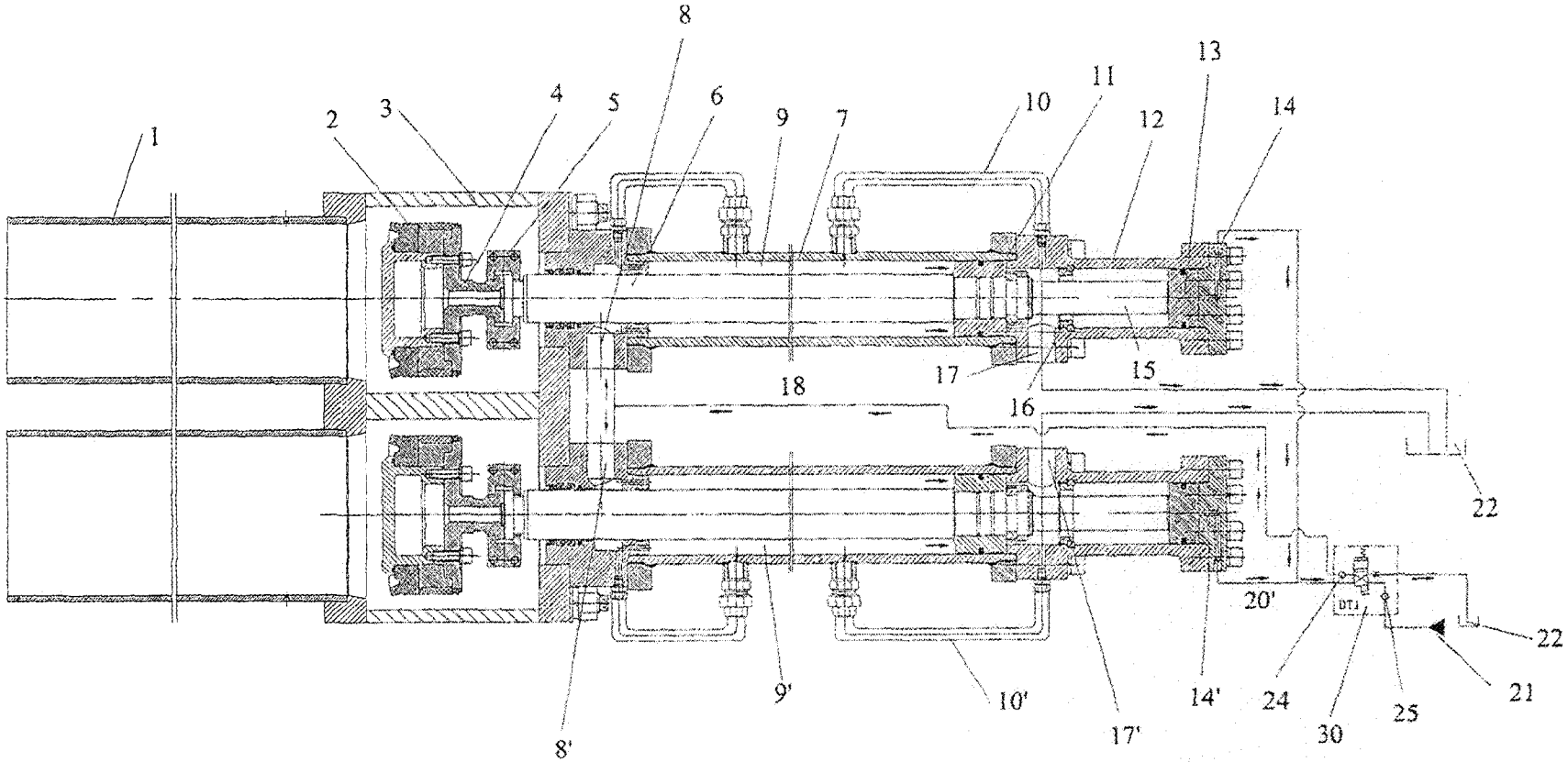
FIG. 9*a* shows the third specific embodiment of the concrete pumping structure of the present invention.
Figure 9B:
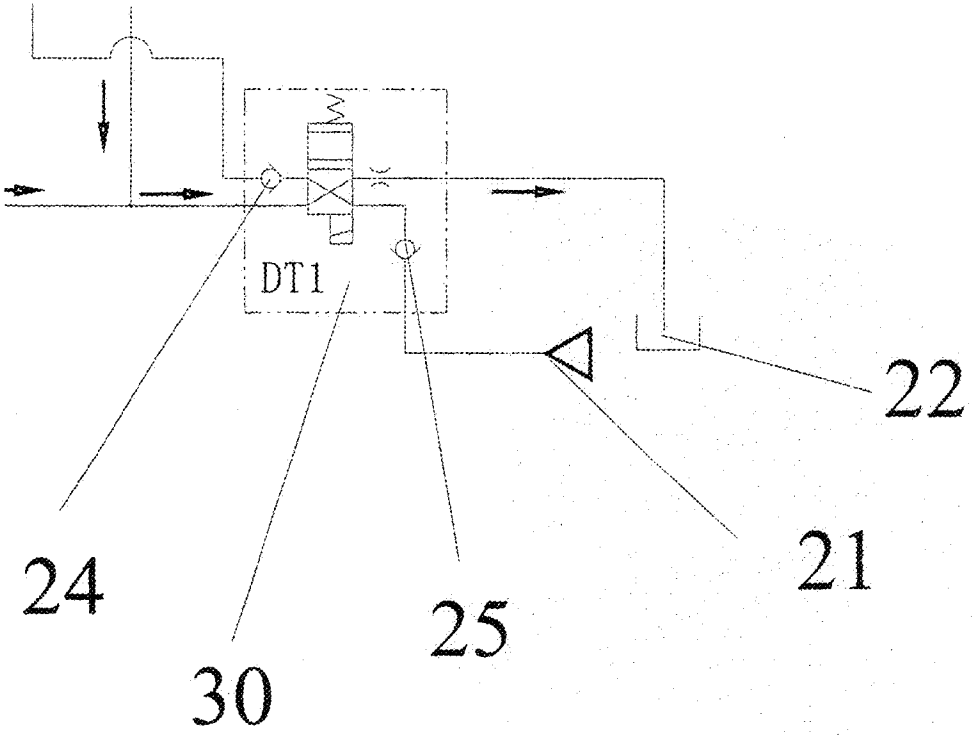
FIG. 9*b* shows an enlarged view of a corresponding hydraulic element.

FIG. 9 shows the third specific embodiment of the concrete pumping structure of the present invention. Being different from the second specific embodiment, the second valve assembly is omitted, and the rodless chamber oil mouths 17, 17' are directed connected with the oil tank via the pipelines 19, 19'. Thus, the concrete is returned back independent of a control device conducting reciprocated driving to the driving oil cylinders.

In the above embodiments the controls over the concrete return pipeline 18 and the auxiliary cylinder oil mouths 14, 14' are integrated in the same concrete return valve assembly. Alternatively, the controls over the concrete return pipeline 18 and the auxiliary cylinder oil mouths 14, 14' can also be conducted separately. For example, the concrete return pipeline 18 is connected with the concrete return valve assembly 30. The concrete return valve assembly 30 comprises a reversing valve and a one-way valve, and the working oil mouth of the reversing valve is connected to the oil inlet of the one-way valve, the oil outlet of the one-way valve is connected to the concrete return pipeline 18, the oil inlet of the reversing valve is connected to a pressure oil source and the oil outlet is connected to the oil return tank. Correspondingly, a control valve assembly similar to the concrete return valve assembly may be additionally provided at the auxiliary cylinder oil mouth of the concrete return auxiliary cylinder, for example, a combination of the reversing valve of a two-position four-way valve and a one-way valve, then the working oil mouth of the reversing valve is connected to the auxiliary cylinder oil mouth, the oil inlet of the reversing valve is connected to the oil outlet of the one-way valve, the oil inlet of the one-way valve is connected to the pressure oil source, and the oil outlet of the reversing valve is connected to an oil return tank.

Figure 10A:
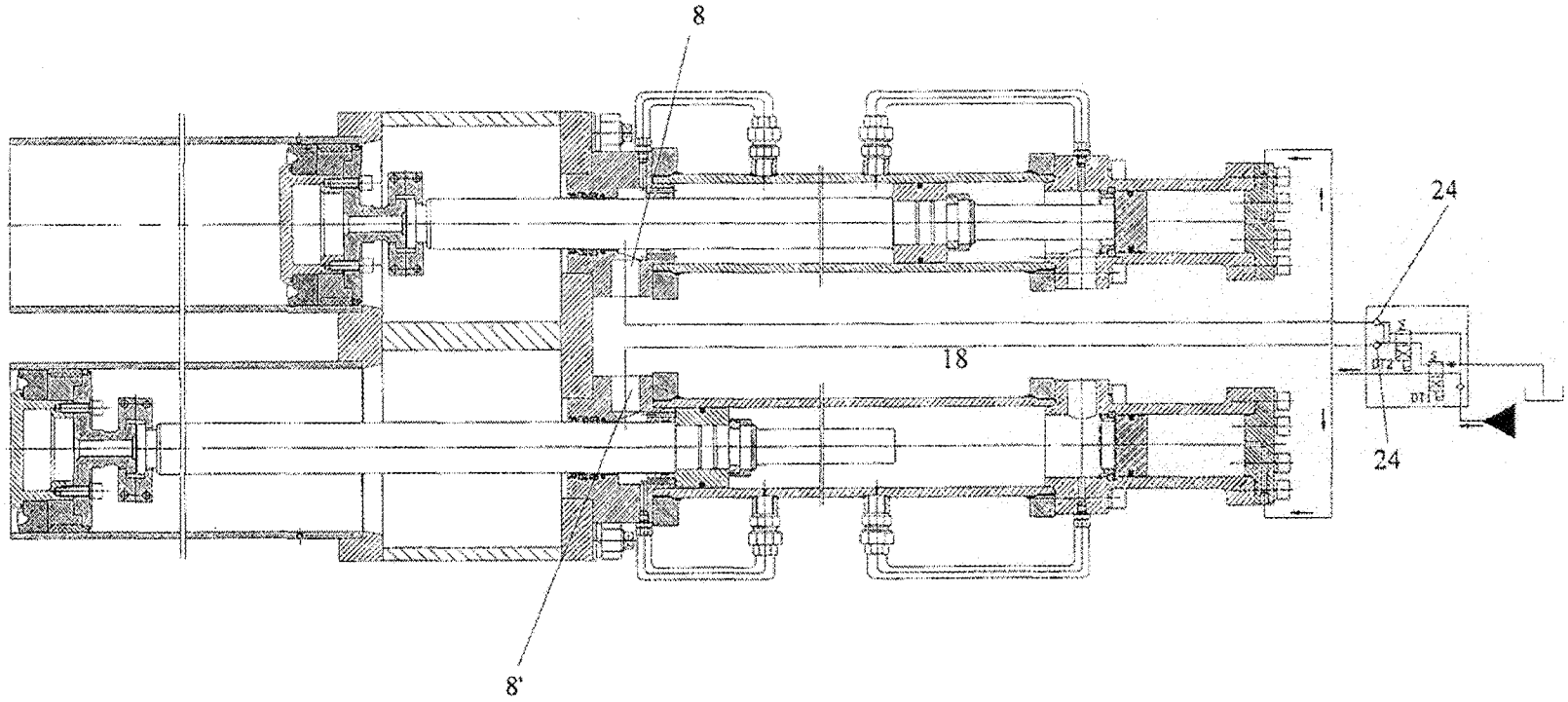
FIGS. 10*a* and 10*b* are respectively views of the working state and the concrete returning state.
Figure 10B:
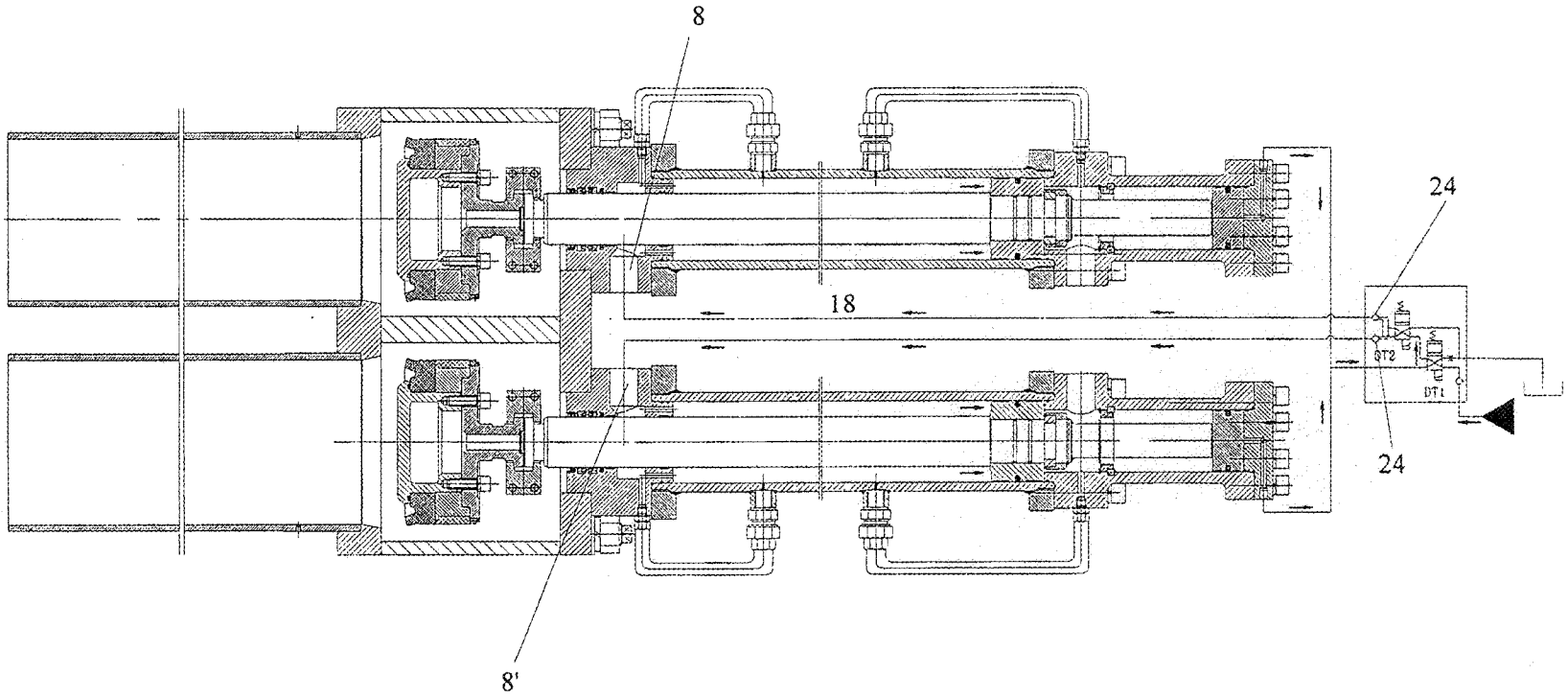
Figure 10C:
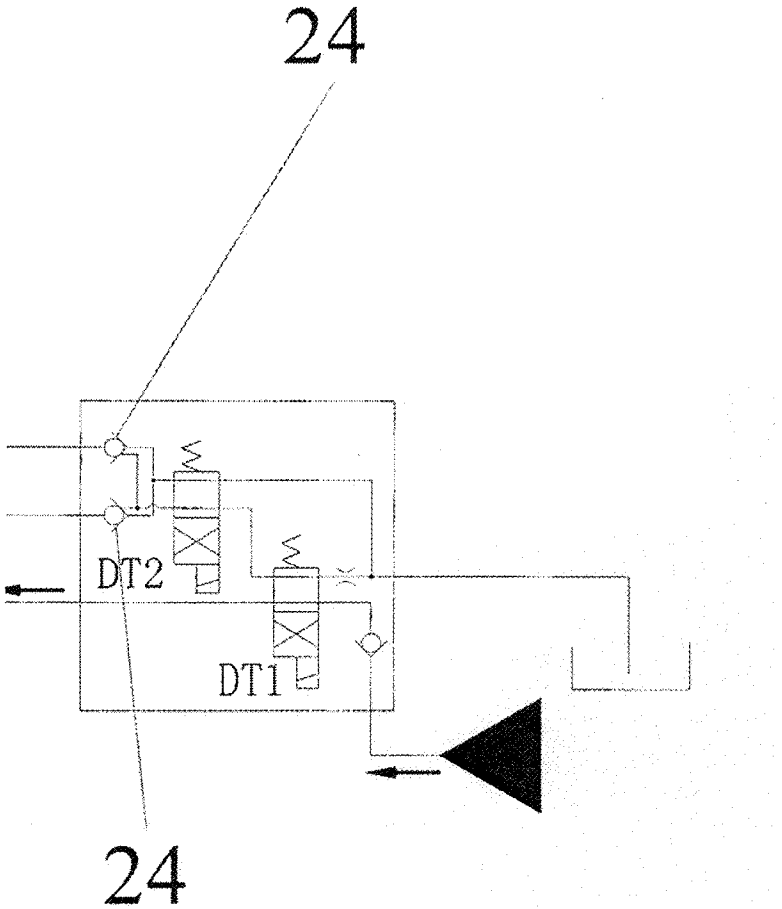
FIG. 10*c* shows an enlarged view of a corresponding hydraulic element.
Figure 11A:
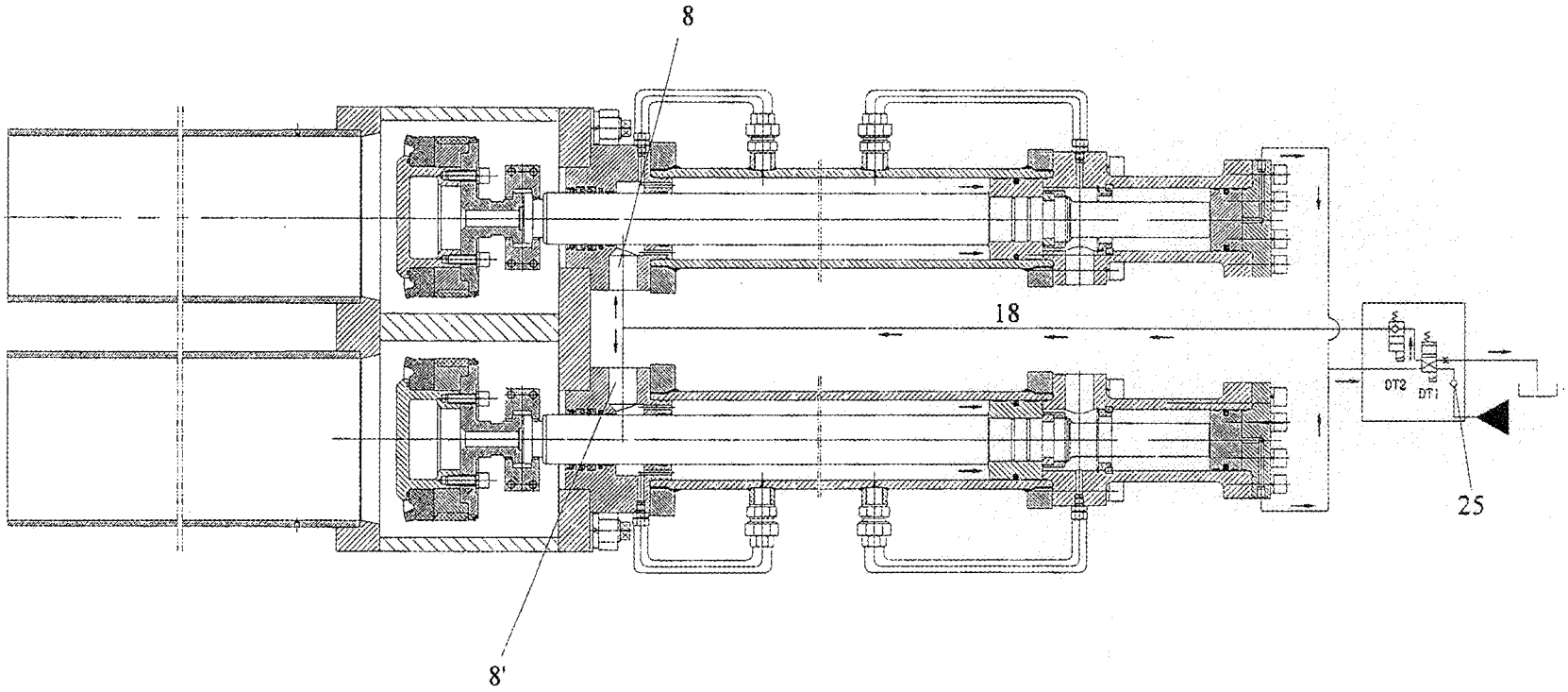
FIGS. 11*a* and 11*b* are respectively views of the concrete returning state and the working state.
Figure 11B:
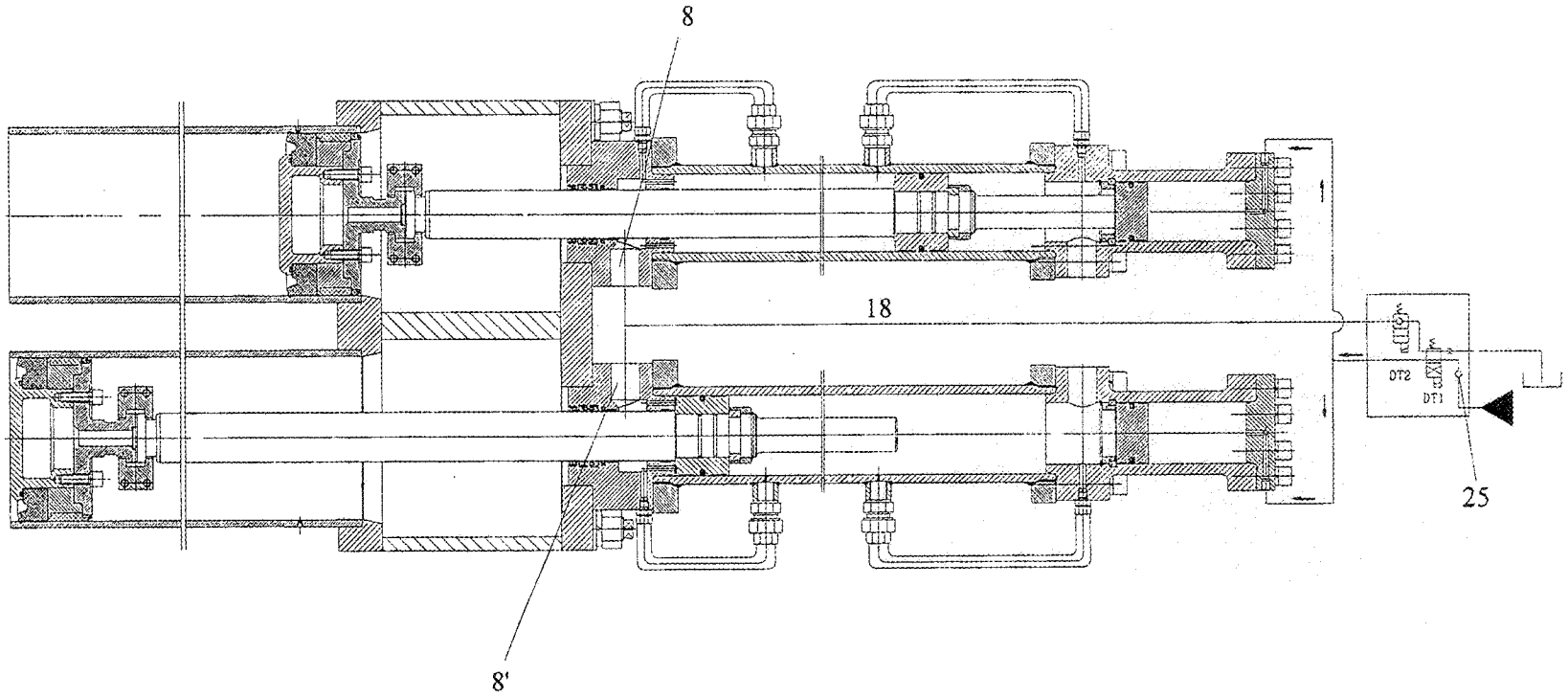
Figure 11C:
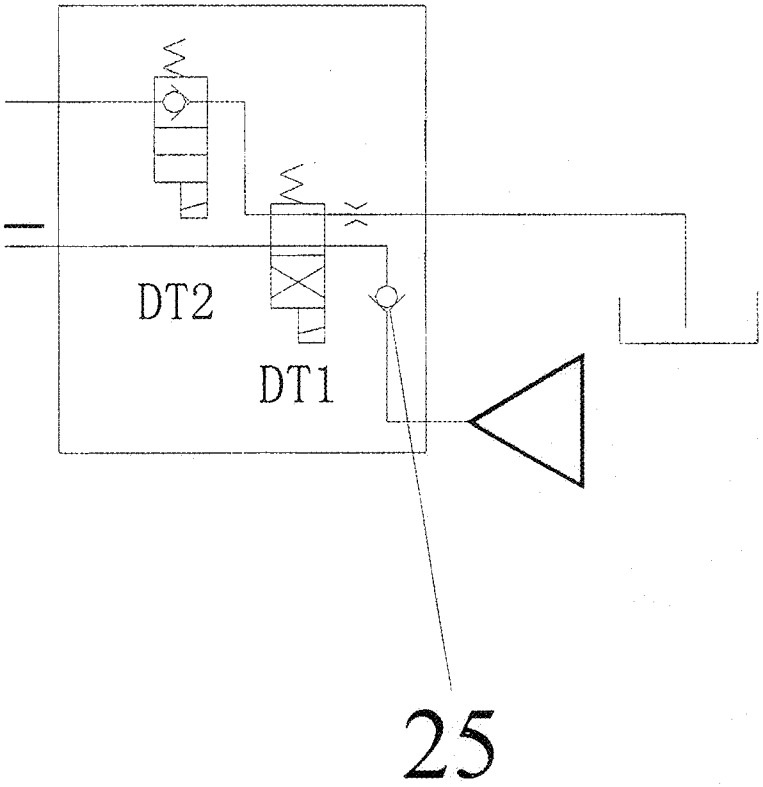
FIG. 11*c* shows an enlarged view of a corresponding hydraulic element.

FIGS. 10 and 11 show the fourth and the fifth specific embodiments of the concrete pumping structure of the present invention. FIG. 10 shows two concrete return pipelines 18 respectively leading to the rod chamber oil mouths 8, 8' of the driving oil cylinders, now the design of the concrete return valve assembly is correspondingly adjusted, in which there are two first one-way valves 24, as shown by the working state in FIG. 10*a* and the concrete returning state in FIG. 10*b*. FIG. 11 shows one concrete return pipeline 18 respectively leading to the rod chamber oil mouths 8, 8' of the driving oil cylinders, and in this embodiment, the concrete return valve assembly comprises a two-position two-way valve DT2 integrating the functions of the first one-way valve and the second reversing valve, a first reversing valve DT1 designed to be a two-position four-way valve, and the second one-way valve 25, as shown by the concrete returning state in FIG. 11*a* and the working state in FIG. 11*b*.

Figure 12A:
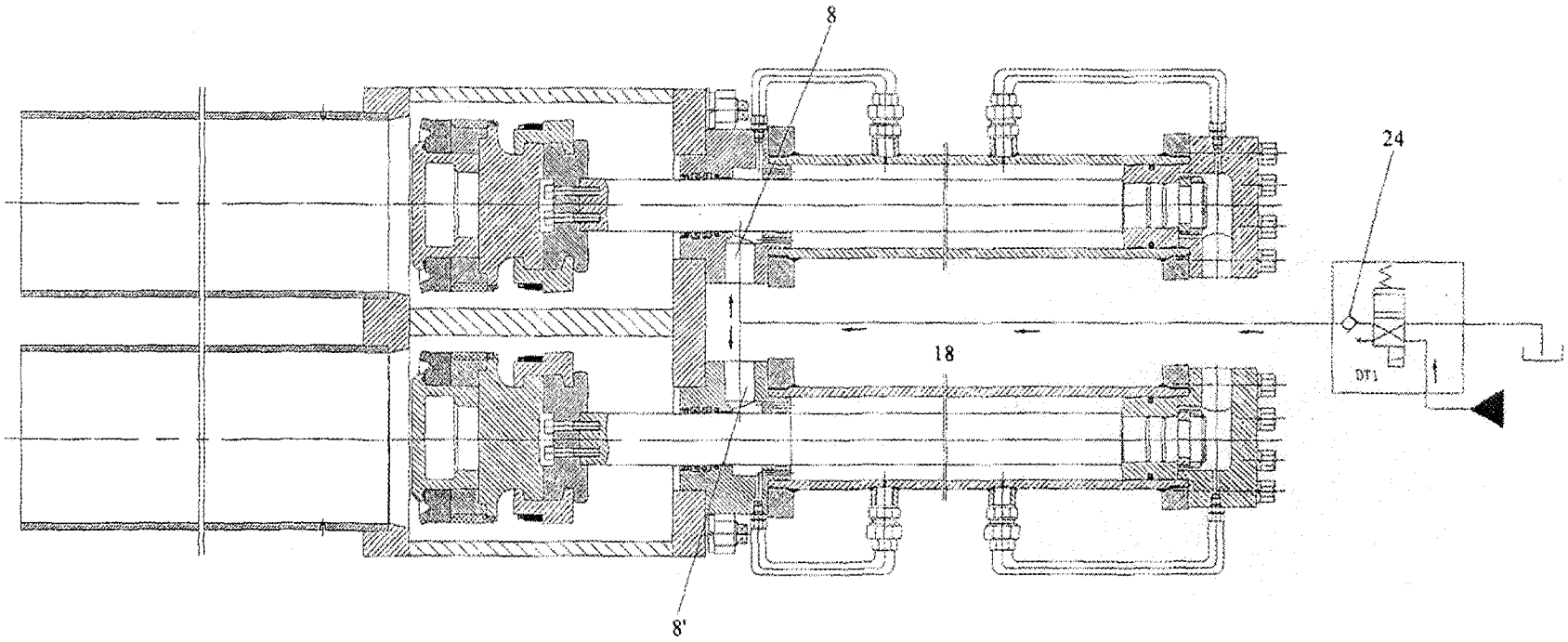
Figure 12B:
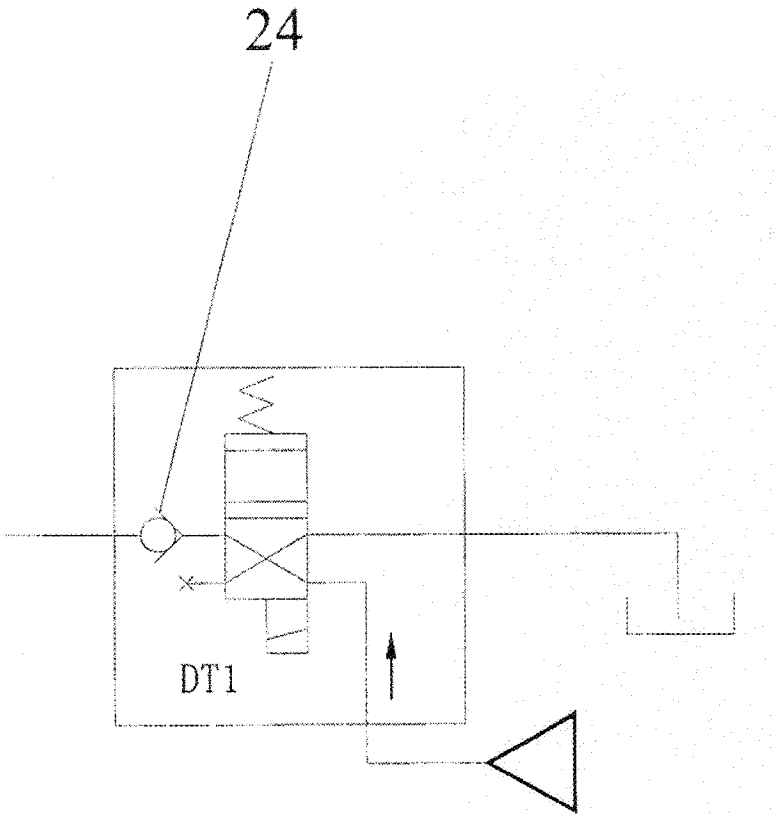
FIGS. 12*b*, 13*b* and 14*b* show enlarged views of corresponding hydraulic elements.
Figure 13A:
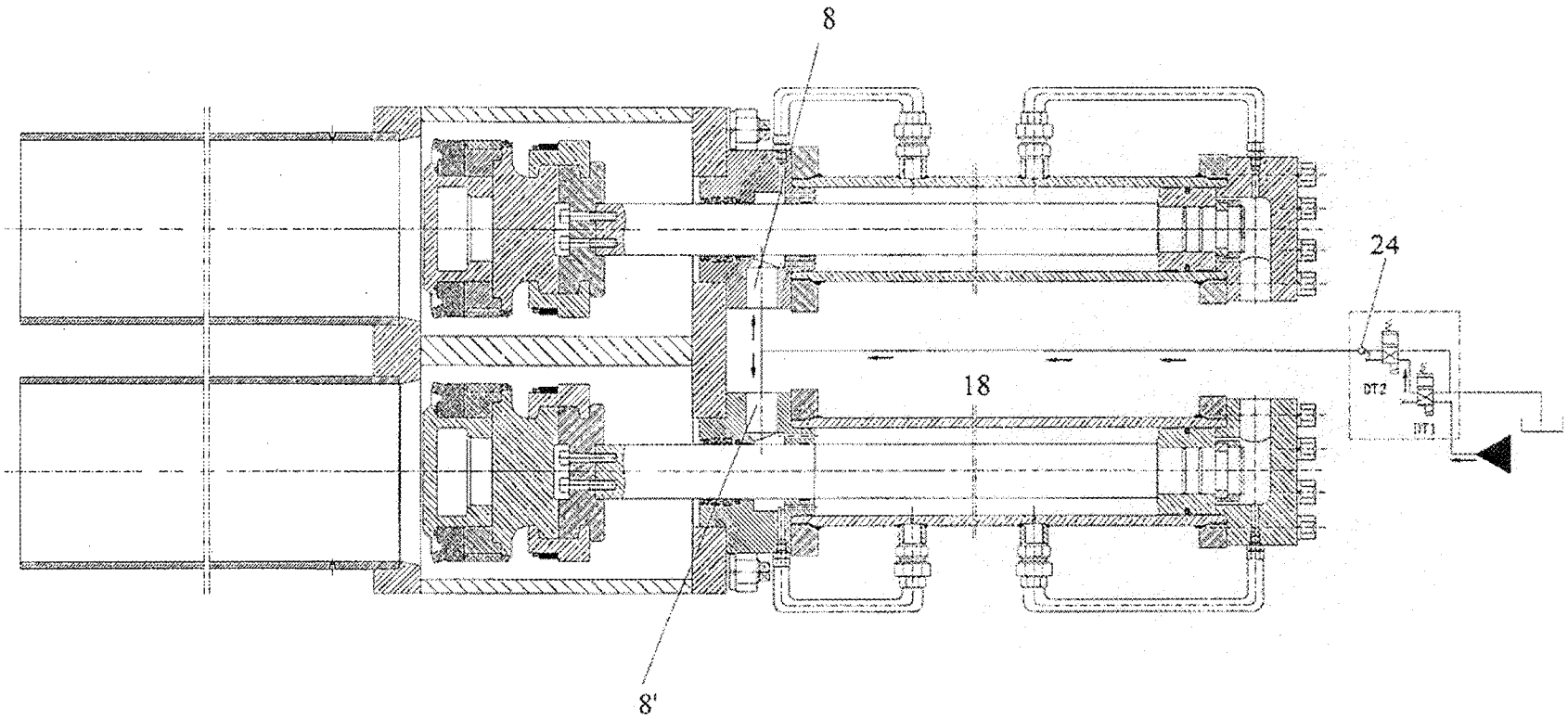
Figure 13B:
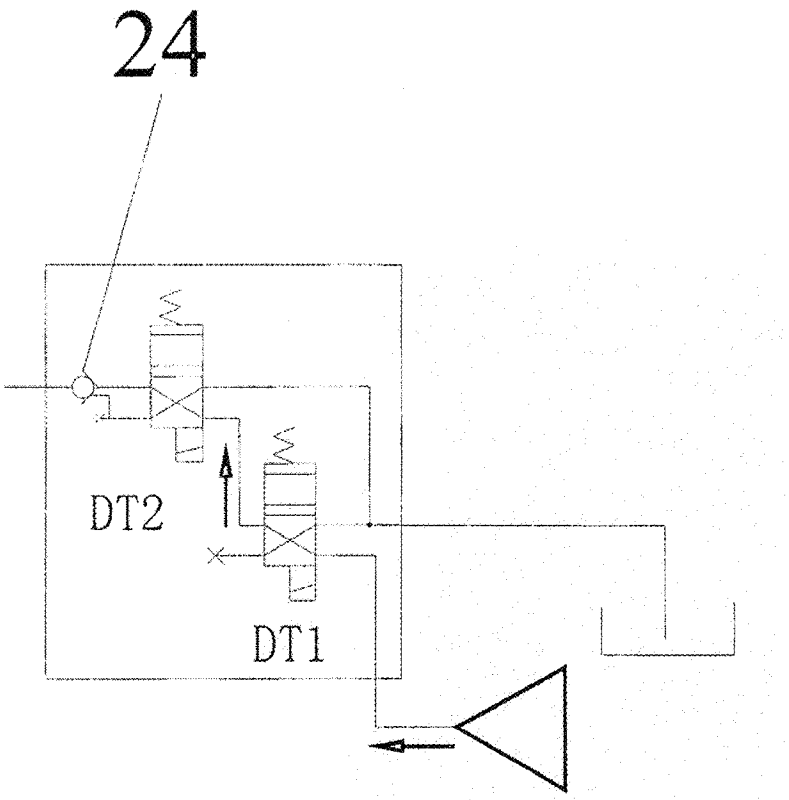
Figure 14A:
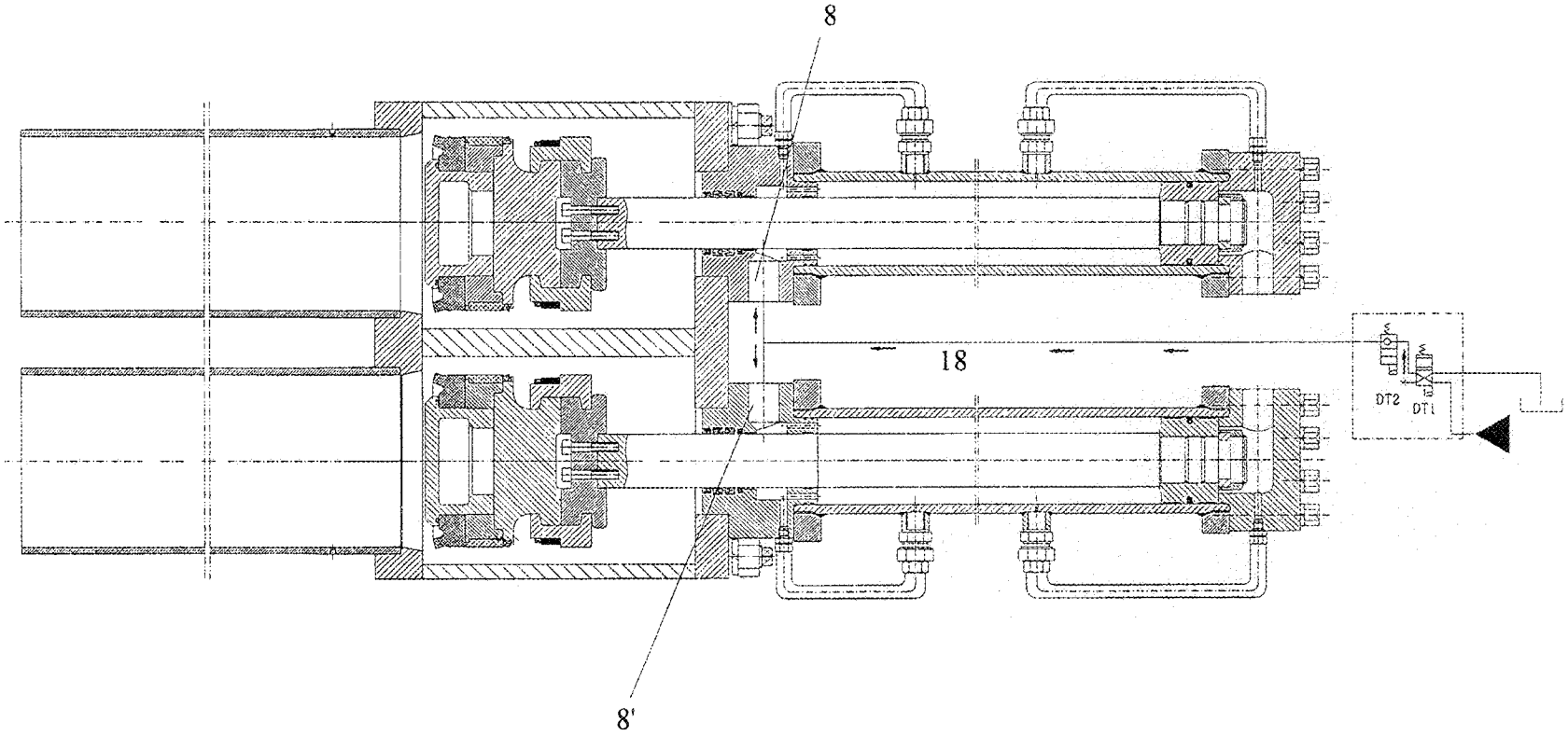
Figure 14B:
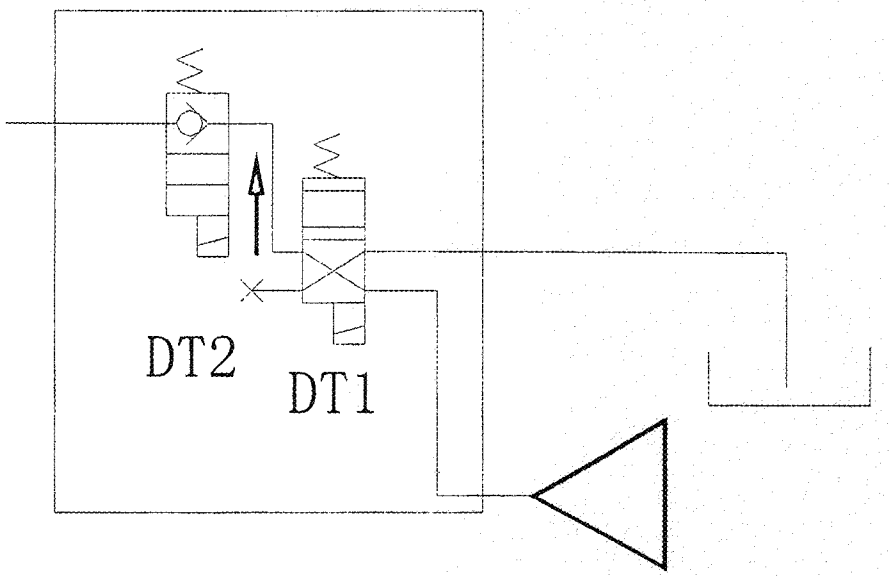

FIGS. 12, 13 and 14 show the sixth, the seventh and the eighth specific embodiments of the concrete pumping structure of the present invention. Wherein, the limit structure is a positioning sleeve, now, to achieve the invention object of returning back two concrete pistons at the same time in the present invention, the positioning sleeve can be disassembled, and then oil is supplied to the rod chamber oil mouths 8, 8' of the driving oil cylinders at the same time through the concrete return valve assembly via the concrete return pipeline 18. In these embodiments, the second valve assembly is not arranged. In the specific embodiment of FIG. 12, the concrete return valve assembly comprises a first one-way valve 24 and a first reversing valve DT1, in which the oil inlet of the first one-way valve 24 is connected to a working oil mouth of the first reversing valve DT1, the oil inlet of the first reversing valve DT1 is connected to the pressure oil source and the oil outlet is connected to the oil return tank. In the specific embodiment of FIG. 13, the concrete return valve assembly comprises a first hydraulic control one-way valve 24, a second reversing valve DT2 and a first reversing valve DT1, in which the oil inlet of the first one-way valve 24 is connected to a working oil mouth of the second reversing valve DT2, the oil inlet of the second reversing valve DT2 is connected to a working oil mouth of the first reversing DT1 and the oil outlet is connected to the oil return tank, and the oil inlet of the first reversing valve DT1 is connected to the pressure oil source and the oil outlet is connected to the oil return tank. In the specific embodiment of FIG. 14, the concrete return valve assembly comprises a two-position two-way valve DT2 integrating the functions of the first one-way valve and the second reversing valve and a first reversing valve DT1 designed to be a two-position four-way valve.

Described above are just preferable embodiments of the present invention and are not intended to restrict the present invention. For one skilled in the art, the present invention may have various modifications and variations. Any modifications, equivalent substitutions, improvements and etc. within the spirit and principle of the present invention shall all be contained within the scope of protection of the present invention.

The invention claimed is:

1. A concrete pumping structure comprising a first pumping cylinder structure and a second pumping cylinder structure, each pumping cylinder structure comprising a delivery cylinder (1), a water tank (3), a driving oil cylinder (7) having a rodless chamber mouth (17) at one end and a rod chamber mouth (8) at the opposite end; wherein the water tank (3) being positioned between the driving oil cylinder (7) and the delivery cylinder (1), the delivery cylinder (1) being provided with a concrete piston assembly (2) inside; wherein, during a pumping process, a piston rod (6) inside the driving oil cylinder (7) drives the concrete piston assembly (2) to reciprocate in the delivery cylinder (1); the concrete pumping structure further comprising a concrete return hydraulic system which controls the two driving oil cylinders and drives the two concrete piston assemblies to return back to their respective water tanks at the same time when the concrete piston assemblies need repair or replacement, wherein each pumping cylinder structure also comprises a limit structure, and during a normal pumping working state, the limit structure limiting and restricting the concrete piston assembly (2) from returning back to the water tank (3), and removes the limiting when the concrete piston assemblies need repair and replacement, allowing the concrete piston assemblies to return back to their respective water tanks, wherein the concrete return hydraulic system comprises a concrete return valve assembly (30) and at least one pressure oil source (21, 23), the concrete return valve assembly controlling the at least one pressure oil source (21, 23), wherein when the limit structure is in a limiting removed state, oil is supplied to the rod chamber oil mouths (8, 8') of the two driving oil cylinders (7, 7') via a concrete return pipeline (18) at the same time, and the oil is returned through the rodless chamber oil mouths (17, 17') of the two driving oil cylinders (7, 7') at the same time.

2. The concrete pumping structure according to claim 1, wherein the limit structure comprises a concrete return auxiliary cylinder (12) located at the end of or in each driving oil cylinder, and the concrete return valve assembly (30) controls the limit oil cylinder to feed oil or return oil through each auxiliary cylinder oil mouth (14, 14') of the concrete return auxiliary cylinder (12), and switches between the normal pumping working state and the limiting removed state.

3. The concrete pumping structure according to claim 2, wherein the limit oil cylinder is provided with a piston (13) therein, each driving oil cylinder is provided with a concrete return rod (15) at the side facing the limit oil cylinder, and limiting is achieved via the concrete return rod (15) and the piston (13) of the limit oil cylinder.

4. The concrete pumping structure according to claim 3, wherein the concrete return valve assembly (30) comprises at least one reversing valve (DT1, DT2).

5. The concrete pumping structure according to claim 4, wherein the concrete return valve assembly (30) comprises a first one-way valve (24), a first reversing valve (DT1) and a second one-way valve (25); the oil outlet of the first one-way valve (24) is connected to the concrete return pipeline (18), a working oil mouth of the first reversing valve (DT1) is connected to the oil inlet of the first one-way valve (24), the other working oil mouth of the first reversing valve (DT1) is connected to the two auxiliary cylinder oil mouths (14, 14'), and the oil inlet of the first reversing valve (DT1) is connected with the oil outlet of the second one-way valve (25) and is thus connected to a first pressure oil source (21), and the oil outlet of the first reversing valve (DT1) is connected to an oil return tank (22).

6. The concrete pumping structure according to claim 4, wherein the concrete return valve assembly (30) comprises a first hydraulic control one-way valve (24), a first reversing valve (DT1), a second one-way valve (25) and a second reversing valve (DT2); the oil outlet of the first hydraulic control one-way valve (24) is connected to the concrete return pipeline (18), the oil inlet of the first hydraulic control one-way valve (24) is connected to a working oil mouth of the second reversing valve (DT2) and the control oil mouth of the first hydraulic control one-way valve (24) is connected to the other working oil mouth of the second reversing valve (DT2), the oil return mouth of the second reversing valve (DT2) is connected to an oil return tank (22) and the oil inlet of the second reversing valve (DT2) is connected to a working oil mouth of the first reversing valve (DT1), the other working oil mouth of the first reversing valve (DT1) is connected to the two auxiliary cylinder oil mouths (14, 14'), and the oil inlet of the first reversing valve (DT1) is connected with the oil outlet of the second one-way valve (25) and thus is connected to a first pressure oil source (21) and the oil return mouth of the first reversing valve (DT1) is connected to the oil return tank (22).

7. The concrete pumping structure according to claim 4, wherein the concrete return valve assembly (30) comprises a first reversing valve (DT1), a second reversing valve (DT2)

and a second one-way valve (25); the second reversing valve (DT2) is integrated with a one-way valve therein, the working oil mouth of the second reversing valve (DT2) is connected to the concrete return pipeline (18), the oil inlet of the second reversing valve (DT2) is connected to a working oil mouth of the first reversing valve (DT1) and the other working oil mouth of the first reversing valve (DT1) is connected to the two auxiliary cylinder oil mouths (14, 14'), the oil inlet of the first reversing valve (DT1) is connected to the oil outlet of the second one-way valve (25) and thus connected to the first pressure oil source, and the oil outlet of the first reversing valve (DT1) is connected to an oil return tank (22).

8. The concrete pumping structure according to claim 1, wherein the limit structure comprises a positioning sleeve additionally provided in the water tank (3), and the positioning sleeve can restrict the concrete piston assembly (2) from returning back to the water tank (3) during operation and can be disassembled during returning back the concrete so as to allow the concrete piston assembly (2) to return back to water tank (3).

9. The concrete pumping structure according to claim 8, wherein the concrete return valve assembly (30) comprises a first one-way valve (24) and a first reversing valve (DT1), the oil outlet of the first one-way valve (24) is connected to the concrete return pipeline (18), and the oil inlet of the first one-way valve (24) is connected to a working oil mouth of the first reversing valve (DT1); and the oil inlet of the first reversing valve (DT1) is connected to a first pressure oil source (21) and the oil return mouth of the first reversing valve is connected to an oil return tank (22).

10. The concrete pumping structure according to claim 8, wherein the concrete return valve assembly (30) comprises a first one-way valve (24), a first reversing valve (DT1) and a second reversing valve (DT2); the oil outlet of the first one-way valve (24) is connected to the concrete return pipeline (18), the working oil mouth of the second reversing valve (DT2) is connected to the oil inlet of the first one-way valve, the oil inlet of the second reversing valve (DT2) is connected to the working oil mouth of the first reversing valve (DT1), the oil inlet of the first reversing valve (DT1) is connected to a first pressure oil source and the oil outlets of the first reversing valve (DT1) and the second reversing valve (DT2) are both connected to an oil return tank (22).

11. The concrete pumping structure according to claim 8, wherein the concrete return valve assembly (30) comprises a first reversing valve (DT1) and a second reversing valve (DT2); the second reversing valve (DT2) is integrated with a one-way valve therein, the working oil mouth of the second reversing valve (DT2) is connected to the concrete return pipeline (18), the oil inlet of the second reversing valve (DT2) is connected to a working oil mouth of the first reversing valve (DT1) and the oil inlet of the first reversing valve (DT1) is connected to a first pressure oil source, and the oil outlet of the first reversing valve (DT1) is connected to an oil return tank (22).

12. The concrete pumping structure according to claim 1 further comprising a second valve assembly, oil being returned back through the rodless chamber oil mouths (17, 17') of the driving oil cylinders (7, 7') under the control of the second valve assembly when the concrete piston assemblies need repair and replacement.

13. The concrete pumping structure according to claim 12, wherein the rod chambers (9, 9') of the driving oil cylinders (7, 7') are in communication with each other, and the rodless chamber oil mouths (17, 17') of the driving oil cylinders (7, 7') are controlled by the second valve assembly so that oil is supplied through the rodless chamber oil mouth (17) and oil is returned back through the other rodless chamber oil mouth (17') during operation.

14. The concrete pumping structure according to claim 13, wherein the second valve assembly comprises a third reversing valve (DT3) and an overflow unloading valve (27).

15. The concrete pumping structure according to claim 14, wherein the rodless chamber oil mouths (17, 17') are respectively connected to the two working oil mouths of the third reversing valve (DT3), and the oil inlet of the third reversing valve (DT3) is connected to a second pressure oil source (23), and the oil return mouth of the third reversing valve (DT3) is connected to an oil return tank (22).

16. The concrete pumping structure according to claim 15, wherein the overflow unloading valve (27) is connected to the oil inlet of the third reversing valve (DT3) at one side between the third reversing valve (DT3) and the second pressure oil source (23), and connected to the oil return tank (22) at the other side.

17. The concrete pumping structure according to claim 16, wherein the overflow unloading valve (27) is a cartridge type overflow unloading valve.

18. The concrete pumping structure according to claim 17, wherein the cartridge type overflow unloading valve (27) comprises a cartridge valve and an electric control valve (DT4) which controls the opening and closing of the cartridge valve.

19. A control method for a concrete pumping structure, comprising normal pumping control and concrete return control, characterized in that the concrete return control comprises the following steps: a) controlling a concrete return valve assembly (30), and supplying oil to the rod chamber oil mouths (8, 8') of two driving oil cylinders (7, 7') at the same time; and b) controlling a second valve assembly, so that oil is returned through the rodless chamber oil mouths (17, 17') of the driving oil cylinders (7, 7') at the same time; the piston rods (6) of the driving oil cylinders bringing two concrete piston assemblies (2) to return back to their respective water tank (3) at the same time, further comprising a step c) which is conducted before step a) or at the same with step a) for removing the limiting function of a limit structure, wherein the limit structure comprises a limit oil cylinder located at the end of or within the driving oil cylinder (7), and the concrete return valve assembly (30) controls returning the oil through the auxiliary cylinder oil mouths (14, 14') of the limit oil cylinder so as to realize the step (c), and controls supplying oil through the auxiliary cylinder oil mouths (14, 14') to switch to a pumping operation state.

20. The control method according to claim 19, wherein the limit structure comprises a positioning sleeve additionally provided within each water tank (3), and the step c) is realized before the step a) by disassembling the positioning sleeve.

* * * * *